US010697367B2

(12) United States Patent
McAndrew et al.

(10) Patent No.: US 10,697,367 B2
(45) Date of Patent: Jun. 30, 2020

(54) ENGINE GENERATOR SET WITH A MORE COMPACT, MODULAR DESIGN AND IMPROVED COOLING CHARACTERISTICS

(71) Applicant: Enchanted Rock, Ltd., Kemah, TX (US)

(72) Inventors: W. Thomas McAndrew, Kemah, TX (US); Mario Joseph Rene Metivier, Lutz, FL (US); Clark James Thompson, Rosharon, TX (US)

(73) Assignee: Enchanted Rock, LTD., Kemah, TX (US)

( * ) Notice: Subject to any disclaimer, the term of this patent is extended or adjusted under 35 U.S.C. 154(b) by 137 days.

(21) Appl. No.: 15/196,311

(22) Filed: Jun. 29, 2016

(65) Prior Publication Data

US 2016/0376976 A1 Dec. 29, 2016

Related U.S. Application Data

(60) Provisional application No. 62/185,831, filed on Jun. 29, 2015.

(51) Int. Cl.
*F02B 63/04* (2006.01)
*F01P 1/06* (2006.01)
(Continued)

(52) U.S. Cl.
CPC ..... *F02B 63/044* (2013.01); *F01P 1/06* (2013.01); *F01P 3/18* (2013.01); *F01P 2001/005* (2013.01)

(58) Field of Classification Search
CPC ..... F01P 11/12; F01P 1/06; F01P 2005/046; F01P 2060/16; F01P 3/20; F01P 5/04; F02B 63/044
See application file for complete search history.

(56) References Cited

U.S. PATENT DOCUMENTS 4,951,871 A 8/1990 Hata et al.
5,551,732 A 9/1996 Bartholomew
(Continued)

FOREIGN PATENT DOCUMENTS

CN 102518511 6/2012
EP 1323906 7/2003
(Continued)

OTHER PUBLICATIONS

PCT/US16/39971, Search Report, dated Oct. 31, 2016, 4 pgs.
Application No. 16818640.1, Extended European Search Report, dated Nov. 11, 2018, 6 pgs.

*Primary Examiner* — Lindsay M Low
*Assistant Examiner* — Ruben Picon-Feliciano
(74) *Attorney, Agent, or Firm* — Egan Peterman Enders Huston

(57) ABSTRACT

Embodiments of an engine generator set are provided herein with a compact, modular design and improved cooling characteristics. The engine generator set embodiments may generally comprise a horizontally shafted engine and alternator, and a cooling system. In some embodiments, the embodiments may include a set of on-board transformers. The cooling system includes one or more components, such as a radiator and one or more electrically driven fans, which are mounted above and/or below the horizontally shafted engine and alternator in a vertical stack. A generator set housing encloses the horizontally shafted engine and alternator, the cooling system and the set of on-board transformers (if included), as well as other generator set components. Due in part to the vertical stacking of the cooling system components, a height of the generator set housing may be substantially larger than a length of the generator set housing, resulting in a substantially reduced footprint, as compared to conventional generator sets.

22 Claims, 15 Drawing Sheets

(51) Int. Cl.
*F01P 3/18* (2006.01)
*F01P 1/00* (2006.01)

(56) References Cited

U.S. PATENT DOCUMENTS

| | | | | |
|---|---|---|---|---|
| 5,626,105 | A | 5/1997 | Locke et al. | |
| 5,890,460 | A | 4/1999 | Ball et al. | |
| 5,899,174 | A | 5/1999 | Anderson et al. | |
| 5,965,999 | A | 10/1999 | Frank | |
| 6,390,031 | B1 | 5/2002 | Suzuki et al. | |
| 6,653,821 | B2 | 11/2003 | Kern et al. | |
| 7,656,060 | B2 | 2/2010 | Algrain | |
| 8,025,477 | B2 | 9/2011 | Ganesh et al. | |
| 8,766,479 | B2 | 7/2014 | Dorn et al. | |
| 2003/0011258 | A1 | 1/2003 | Kern et al. | |
| 2004/0040313 | A1* | 3/2004 | Kurokawa | F01D 25/24 60/796 |
| 2005/0160740 | A1 | 7/2005 | Nakano et al. | |
| 2006/0054113 | A1 | 3/2006 | Yasuda et al. | |
| 2011/0315538 | A1 | 12/2011 | Kim et al. | |
| 2013/0113219 | A1 | 5/2013 | Honkanen et al. | |

FOREIGN PATENT DOCUMENTS

| | | |
|---|---|---|
| EP | 2472080 | 10/2015 |
| JP | 10141088 | 5/1998 |
| WO | 2015048544 | 4/2015 |

* cited by examiner

ENGINE GENERATOR SET WITH A MORE COMPACT, MODULAR DESIGN AND IMPROVED COOLING CHARACTERISTICS

This application is a continuation of U.S. Patent Application No. 62/185,831, filed on Jun. 29, 2015 and entitled "Engine Generator Set With A More Compact, Modular Design And Improved Cooling Characteristics" the entire disclosure of which is incorporated herein by reference.

BACKGROUND OF THE INVENTION

1. Field of the Invention

This invention relates to engine generator sets and, more particularly, to engine generator sets with a more compact, modular design and improved cooling characteristics.

2. Description of the Relevant Art

The following descriptions and examples are provided as background only and are intended to reveal information that is believed to be of possible relevance to the present invention. No admission is necessarily intended, or should be construed, that any of the following information constitutes prior art impacting the patentable character of the subjected mater claimed herein.

An engine generator set (otherwise referred to as a "generator set" or "gen-set") is the combination of an electrical generator and an engine (prime mover), which are mounted together to form a single piece of equipment. Engine generator sets are available in a wide range of power ratings, including small, portable units that can supply several hundred watts of power, hand-cart mounted units that can supply several thousand watts, and stationary or trailer-mounted units that can supply over a million watts. Regardless of the size, generator sets may run on a variety of different fuels, such as gasoline, diesel, natural gas, propane (liquid or gas), bio-diesel, sewage gas or hydrogen. Most of the smaller units are built to use gasoline as a fuel, while larger units typically use diesel, natural gas or propane.

Engine generator sets are often used to supply electrical power in places where utility power is not available, or where power is needed only temporarily or as a backup. Small generators are sometimes used to supply power tools at construction sites. Trailer-mounted generators supply power for temporary installations of lighting, sound amplification systems, amusement rides, etc., and may also be used for emergencies or backup where either a redundant system is required or no generator is on site.

Standby power generators are permanently installed at an installation site and are generally kept ready to supply power during temporary interruptions of the utility power supply. Hospitals, communications service installations, data processing centers, sewage pumping stations and many other important facilities are often equipped with standby power generators, as well as some businesses and residences. Some standby power generators can automatically detect the loss of grid power, start the engine, run using fuel from a natural gas line, detect when grid power is restored, and then turn itself off—with no human interaction.

Engine generator sets utilized for standby power generation can provide anywhere from about 6 kW to about 3250 kW or more of single phase or three phase power at a variety of different output voltages and frequencies. As shown in FIG. 1, the main components of an engine generator set include an internal combustion engine 1, electrical generator 2, fuel system 3, voltage regulator 4, cooling and exhaust systems 5, lubricating systems 6, battery charger 7 and control panel 8. These components are typically mounted on the generator's skid base (or main assembly/frame) 9 and enclosed within a generator set housing or enclosure (not shown in FIG. 1).

The internal combustion engine 1 provides a mechanical energy input to the electrical generator or alternator 2, which converts the mechanical energy into an electrical output. The size of the engine is directly proportional to the maximum power output the generator can supply. As noted above, the engine may run on a variety of different fuels, such as gasoline, diesel, natural gas, propane, etc. In the case of smaller engine generator units, the fuel system 3 may include a fuel tank, which is mounted to the generator's skid base or on top of the generator frame 9. For commercial applications, it may be necessary to erect and install an external fuel tank, or provide a connection to a utility gas line. The lubricating system 6 provides lubricants to the moving parts of the engine.

In generator sets used for standby power generation, the engine crank shaft is typically coupled to the electrical generator 2 along a horizontal axis. The electrical generator 2 is typically a high efficiency alternator having a rotor coupled to the engine crank shaft and a stator coupled for supplying alternating current to an electronic control section, which controls operation of the alternator and internal combustion engine. The voltage regulator 4 regulates the AC voltage produced by the alternator 2 by determining whether and by how much the sensed voltage/current deviates from desired values.

During operation, heat is produced by both the engine 1 and the alternator 2 and this heat must be removed from the enclosure for proper system operation. Heat may be removed by a variety of different cooling and exhaust systems 5, including both air and liquid cooling systems. One conventional solution for removal of heat is to provide separate mechanically driven fans for the engine 1 and the alternator 2. In a horizontally shafted engine 1, the engine crank shaft is coupled at one end to the rotor of the alternator 2, and at an opposite end to a fan 5 mounted within a sidewall of the generator set housing. The fan is driven by the engine crank shaft to blow cooling air over the engine. In many cases, a second fan (not shown in FIG. 1) may be coupled to the engine crank shaft between the engine 1 and the alternator 2 to cool the rotor windings and provide additional engine cooling. Because these fans are both driven by the engine crank shaft, they only provide cooling when the engine is running. These mechanically driven fans are also very noisy and inefficient, since fan speed is directly related to engine speed and cannot be optimized for temperature.

In some cases, the generator set may also include an electronic control section including a control panel, a controller, and one or more output sensors and electrical circuit breaker(s). The output of the alternator 2 may be fed through the output sensors and the electrical circuit breaker(s) to the output lines of the generator set. The controller is typically a microcomputer based subsystem that executes a control program to govern the operation of the alternator 2. The controller may receive signals from the control panel 8 and the output sensors, which sense the voltage and current levels of the electricity produced by the alternator, and from those signals may derive the frequency and polarity of the AC current and voltage produced by the alternator. The electrical circuit breaker(s) may operate to open and close a set of contacts that connect the output lines of the generator set to an electrical distribution system or customer load.

In some cases, a number of generator sets may be coupled in parallel as energy sources in what is called a "paralleling system." In a paralleling system, the output lines of each generator set are typically coupled to a three-phase parallel electrical bus having three separate conductors. In some cases, parallel electrical bus may be connected through a main distribution panel to various loads within a structure (such as a building or residence), a campus or other facility. The main distribution panel typically includes a single, large transformer for transforming the AC voltage (e.g., 480V) output from all parallel-coupled generator sets to a substantially higher voltage (e.g., 12,470 V), which can be supplied to the loads. Unfortunately, using a single, large transformer at the main distribution panel presents a single point of failure to the paralleling system. In addition, a single large transformer also requires larger inrush currents when energized, and therefore, limits the number that can be energized at once from a single generator set.

In other cases, the parallel electrical bus may be coupled to utility power lines by an automatic transfer switch (ATS), which detects when electricity from the utility lines is interrupted and disconnects the parallel electrical bus from the utility lines in response. In such cases, the parallel-coupled generator sets can export power and energy to the utility grid if: (a) suitable transformers are provided to allow the voltages produced by the generator sets to be stepped up to a voltage that is equivalent to the delivery voltage of the local utility grid, and (b) additional control equipment is provided to allow the waveforms of the electricity produced by the generator sets to be synchronized with those of the utility. In order to parallel synchronously to the utility lines, the AC voltages output from the parallel-coupled generator sets must be stepped up to voltages ranging from about 2,400-38,000 volts by a transformer with sufficient capacity to export the entire capacity of the group of paralleled generator sets. However, using a single, large transformer for such purpose has many disadvantages, as noted above.

In addition to the problems associated with using a single, large transformer to transform the AC voltage output from the parallel-coupled generator sets, the large output current generated by each generator set requires relatively large and expensive cables to be used to connect the output from each generator set to the parallel electrical bus. For example, a generator set configured to provide three phase AC voltage of 480/277V at approximately 350 KW generates approximately 585 A of AC current per phase. At these output current levels, two sets of large 500MCM cables are required per phase and neutral, which results in 8 large wires. Another disadvantage of connecting the generator set output lines to the transformer at the main distribution panel is that long runs of 500MCM cables are subject to losses from the resistance of the wires to large current flow.

As noted above, the components of each generator set are typically enclosed within a generator set housing or enclosure. In many cases, the generator set housing is substantially rectangular in shape, and because of the horizontal arrangement of components (see, FIG. 1), the generator set housing is often significantly greater in length than in width and height. Particular dimensions of conventional generator set housings vary greatly for different power ratings and configurations, although it is safe to say that generator sets with larger power ratings generally have larger footprints. For example, the length of a smaller generator set providing only 6 kW of power may be as little as 3-5 feet, whereas a larger generator set providing about 350 kW of power may be about 15-20 feet in length. It is easy to recognize how real estate is quickly consumed when a number of larger generator sets are coupled together in a paralleling system.

SUMMARY OF THE INVENTION

The following description of various embodiments of an engine generator set is not to be construed in any way as limiting the subject matter of the appended claims.

According to one embodiment, an engine generator set includes an internal combustion engine coupled to an alternator, so that the engine crank shaft extends along a horizontal axis to couple with a rotor of the alternator to form a horizontally shafted engine and alternator, and a cooling system. The cooling system includes one or more components, which are mounted above and/or below the horizontally shafted engine and alternator in a vertically stacked configuration. A generator set housing encloses the horizontally shafted engine and alternator and the cooling system. Due to the vertical stacking of the generator set components, a height of the generator set housing may be equal to or larger than a length of the generator set housing. In some embodiments, one or more on-board transformers may also be arranged within the generator set housing and coupled to an output of the alternator for transforming the AC current and voltage generated thereby.

The cooling system may generally comprise a radiator, which is coupled for providing liquid cooling to the internal combustion engine, and one or more electrically driven fans, which are coupled for providing air cooling to at least the internal combustion engine and the alternator. According to one embodiment, the radiator may be mounted above the horizontally shafted engine and alternator, and the one or more electrically driven fans may be mounted below the horizontally shafted engine and alternator within an air plenum, which encompasses the electrically driven fans and draws air up and over the horizontally shafted engine and alternator to cool the engine and alternator. If included, the one or more on-board transformers may also be arranged within the air plenum and cooled by the air drawn up by the electrically driven fans.

According to another embodiment, the radiator may be mounted above the horizontally shafted engine and alternator, and the one or more electrically driven fans may be mounted above the radiator for drawing air up and over the horizontally shafted engine and alternator to cool the engine and alternator. If included, the one or more on-board transformers may also be cooled by the air drawn up by the electrically driven fans.

According to another embodiment, an engine generator set includes an engine compartment comprising a horizontally shafted engine and alternator, and a cooling compartment, which is mounted above and separated from the engine compartment by a vented partition. The engine generator set may also include a generator set housing encompassing the engine compartment and the cooling compartment. Due to the stacked configuration of the engine and cooling compartments, a height of the generator set housing may be equal to or larger than a length of the generator set housing.

In general, the cooling compartment may include one or more electrically driven fans, which are configured to cool the engine compartment by drawing heated air from the engine compartment through the vented partition separating the engine and cooling compartments. In some embodiments, the vented partition may include a pair of inclined planar sides, which extend at an angle from inner surfaces of the generator set housing to meet at a central ridge. Openings within the central ridge may enable the heated air from the engine compartment to be drawn into the cooling compartment by the one or more electrically driven fans. In some embodiments, the vented partition may include a ridge vent, which covers and runs a length of the central ridge to protect the engine compartment from ingress of water or debris.

In some embodiments, the cooling compartment may also include a radiator, which is coupled for supplying a cooling liquid to the engine through inlet lines and receiving a return liquid, which has been heated by the engine, through return lines. The inlet lines and return lines coupled to the radiator may pass through orifices in the vented partition. In some embodiments, seals may be coupled around the inlet and return lines for sealing the orifices through which the inlet lines and return lines pass through the vented partition.

In some embodiments, the engine compartment may include one or more ventilation openings arranged on one or more sides of the generator set housing to provide an air inlet into the engine compartment. Likewise, the cooling compartment may include one or more ventilation openings arranged on one or more sides of the generator set housing to provide an air outlet from the cooling compartment. Any type of ventilation openings into the engine and cooling compartments may be used, including but not limited to, louvered slats, screens, perforations, etc.

In some embodiments, the engine compartment may also include one or more air filters arranged within one or more air plenums. The air filters may be coupled for supplying filtered air to the engine via one or more air intake pipes. The air plenums may be coupled to inside surfaces of the generator set housing adjacent to the ventilation openings in the engine compartment. The air plenums may be generally configured to receive and surround the air filters to ensure that cooler, outside air is drawn into the engine via the air filters and air intake pipes, as opposed to heated air from the engine compartment.

In some embodiments, each air filter may be arranged within a separate air plenum. In some embodiments, each air plenum may be centered around one of the ventilation openings in the engine compartment. In some embodiments, each air plenum may be large enough to receive one air filter, yet small enough to limit the amount of heated air that is pulled into the air filter from the engine compartment. In some embodiments, each air plenums may be implemented as a three-sided box having an angled bottom and an open top. The open top may be configured to receive only one of the air filters. An open fourth side of the three-sided box may be attached to an inside surface of the generator set housing adjacent to a ventilation opening in the engine compartment. The open fourth side of the three-sided box may be attached to the inside surface of the generator set housing by substantially any mechanical means.

BRIEF DESCRIPTION OF THE DRAWINGS

Other objects and advantages of the invention will become apparent upon reading the following detailed description and upon reference to the accompanying drawings.

Figure 1:
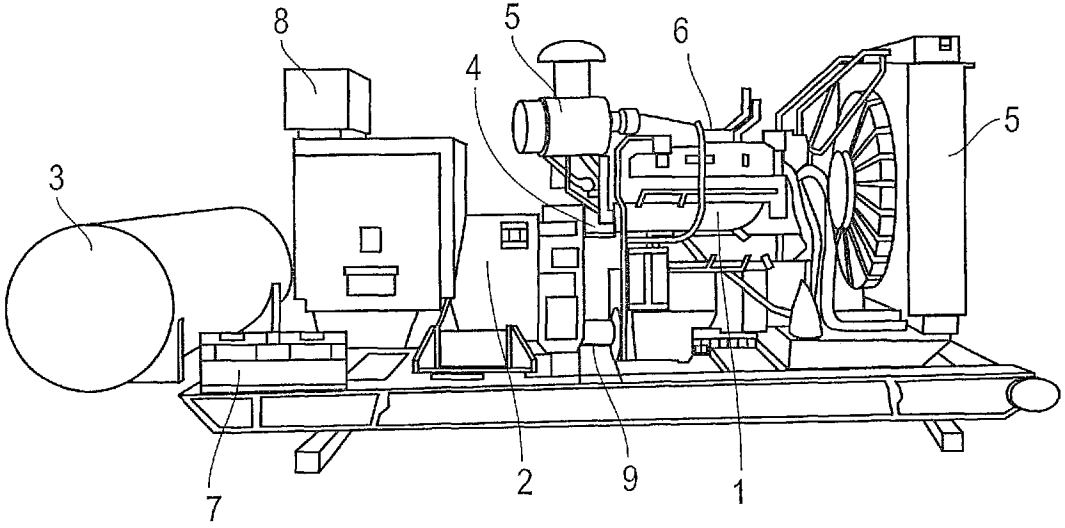
FIG. 1 (Prior Art)
FIG. 1 is a front view of a conventional engine generator set.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

Various embodiments of engine generator sets (otherwise referred to as "generator sets" or "gen-sets") with a more compact, modular design and improved cooling characteristics are illustrated in FIGS. 2-20 and described herein. As noted above with respect to FIG. 1, an engine generator set may include various components configured for generating electrical power, various components configured for controlling the generation of electrical power, and various components configured for cooling and/or lubricating the power generating components of the engine generator set. While FIGS. 2-20 depict exemplary arrangements and configurations for the components, which are primarily responsible for generating electrical power, controlling the generation of electrical power, and cooling and/or lubricating the power generating components of the engine generator set, it is noted that the figures may not depict all components needed for the engine generator sets described herein to function. Only those components that are relevant to the understanding of the embodiments described herein are depicted in the figures and discussed herein.

As in conventional generator sets, the embodiments of generator sets disclosed herein may generally include an internal combustion engine and alternator, which are disposed within a generator set housing, so that the engine crank shaft extends along a substantially horizontal axis to couple with the rotor of the alternator. Such an engine may be otherwise referred to herein as a "horizontally shafted engine." Instead of mounting additional generator set components at either ends of the combined engine/alternator, as shown in the embodiment of FIG. 1, the generator sets described herein mount such components above and/or below the combined engine/alternator to provide a more compact design with a significantly decreased footprint.

In some embodiments, the generator sets described herein may provide a compact, modular design, not only by mounting the additional generator set components above and/or below the combined engine/alternator, but also by including all components needed to generate and convert electrical power within the confines of the generator set housing. For example, some embodiments described herein may reduce engineering and installation costs by including one or more on-board transformers within the generator set housing for converting the electrical power generated by the combined engine/alternator to a desired output voltage/current level. While beneficial, the inclusion of on-board transformers within the generator set housing is not strictly necessary, and therefore, these transformers may be omitted from some embodiments.

In some embodiments, the generator sets described herein may comprise an engine compartment and a cooling compartment, which are coupled together yet separated from one another by a vented partition. The vented partition ensures that water (or other debris) does not enter the engine compartment, and in some cases, may enable the cooling compartment to be removed from the engine compartment for maintenance or other purposes. Numerous additional advantages are also provided by the various embodiments of generator sets described herein. For example, noise is reduced and efficiency is increased by decoupling the fan from the engine crank shaft. This provides the advantage of optimizing the cooling system, such that fan speed is controlled by engine temperature rather than engine speed. Other advantages of the embodiments described herein may be apparent to a skilled artisan upon reading this disclosure.

An improved engine generator set 10, according to a first embodiment is shown in FIGS. 2-5. The improved generator set 10 includes many of the components typically found in a conventional generator set, such as an internal combustion engine 12 coupled for providing a mechanical input to an electrical generator or alternator 14, which in turn, is configured for converting the mechanical input to an electrical output in the form of AC current and voltage. Like conventional generator sets, the crank shaft (not shown) of engine 12 extends along a substantially horizontal axis 13 to couple with and drive the rotor (not shown) within the alternator 14. Unlike conventional generator sets, however, additional components of the improved generator set 10 are mounted above and/or below the combined engine/alternator to significantly reduce the footprint of the improved generator set 10.

The size of the engine 12 is directly proportional to the maximum power output of the alternator 14, and may vary greatly for different power ratings. However, the configuration shown in FIGS. 2-5 is particularly suitable for stationary generator sets (i.e., generator sets permanently installed on-site), which are configured to provide approximately 100 KW to approximately 3000 KW of standby power. Conventional generator sets with power ratings between about 100 KW and 3000 KW typically have very large footprints. In one example, a conventional generator set configured to provide about 350 kW of standby power may have a length of about 17 feet, a width of about 6 feet and a height of about 6-7 feet when enclosed within a generator set housing. In contrast, the generator set 10 shown in FIGS. 2-5 may have a significantly smaller length (L) of about 9 feet, a slightly larger width (W) of about 8.5 feet and a larger height (H) of about 10-12 feet, in one embodiment. Although the exact dimensions of the generator set 10 may differ in other embodiments, the height (H) of the generator set 10 will typically be larger than the length (L) of the generator set 10, due to the vertical stacking of the generator set components. This significantly reduces the footprint of the improved generator set 10, resulting in a more compact design.

As shown in FIGS. 2-5, the components of generator set 10 are enclosed within a generator set housing 28. In the embodiment illustrated in FIGS. 2-5, the shape of the generator set housing 28 may be generally described as a rectangular prism, or cuboid. The height (H) of the generator set housing may be substantially larger than the length (L) of the generator set housing. The generator set housing may be dimensioned as discussed above. In some embodiments, edges of the generator set housing 28 may be beveled, as shown in FIGS. 2-5, although beveled edges are not strictly necessary. In some embodiments, one or more on-board transformers 16 may be disposed within the generator set housing 28 to provide generator set 10 with a more modular design, as described in more detail below.

Although the exact dimensions of generator set 10 may differ from the examples provided above, reducing the generator set footprint (L×W) enables a greater number of the generator sets described herein to be installed within a given installation area, as compared to conventional generator sets. The compact design and modularity provided by generator set 10 also reduces engineering and installation costs, and enables multiple generator sets 10 to be electrically coupled together in parallel, yet physically arranged in unique configurations to fit within the boundaries of a particular installation site. In doing so, a particular installation site may be designed to provide significantly greater standby power than would be possible with parallel sets of conventional generator sets.

One of the more challenging problems faced by conventional generator sets is the need to remove heat, which is generated by the engine and alternator, from the generator set housing 28 or enclosure. As noted in the background section, conventional generator sets typically mount a number of mechanically driven fans directly to the engine crank shaft for blowing cooling air over the engine and alternator.

For example, a relatively large fan (see, FIG. 1) may be mounted within a sidewall of the enclosure and coupled to one end of the engine crank shaft for drawing cooler air from outside the enclosure over the engine. If a radiator is included to provide liquid cooling to the engine, the radiator is typically coupled between the fan mounted within the sidewall of the enclosure and the engine. In most cases, a second, somewhat smaller fan may be coupled to the engine crank shaft between the engine and the alternator to cool the rotor windings and provide additional engine cooling. Because these two fans are mechanically driven by the engine crank shaft, they only provide cooling when the engine is running and their speed is fixed by the speed of the engine necessary to produce 50-60 Hz AC electricity. The mechanically driven fans included within conventional generator sets are also very noisy and inefficient, since fan speed is directly related to engine speed and cannot be optimized for temperature.

Figure 3:
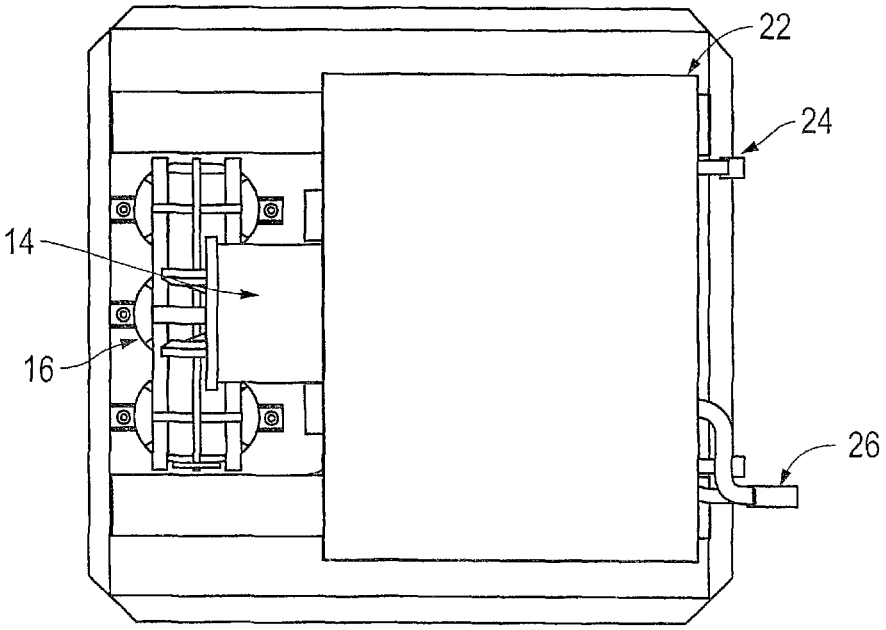
FIG. 3 is a top view of the engine generator set shown in FIG. 2.
Figure 4:
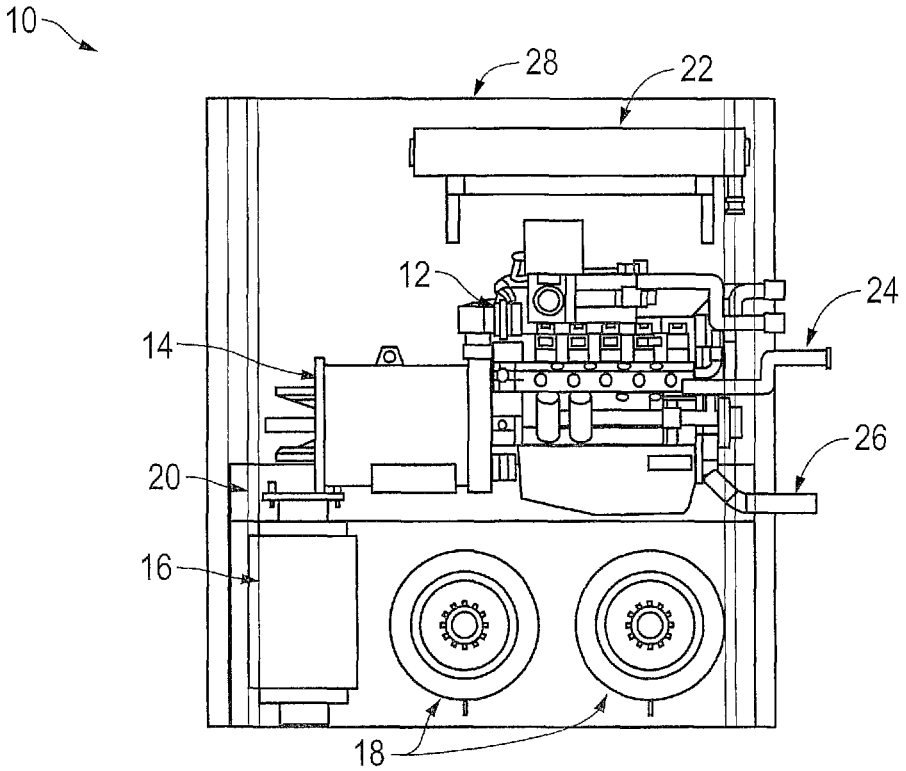
FIG. 4 is a front view of the engine generator set shown in FIG. 2.
Figure 5:
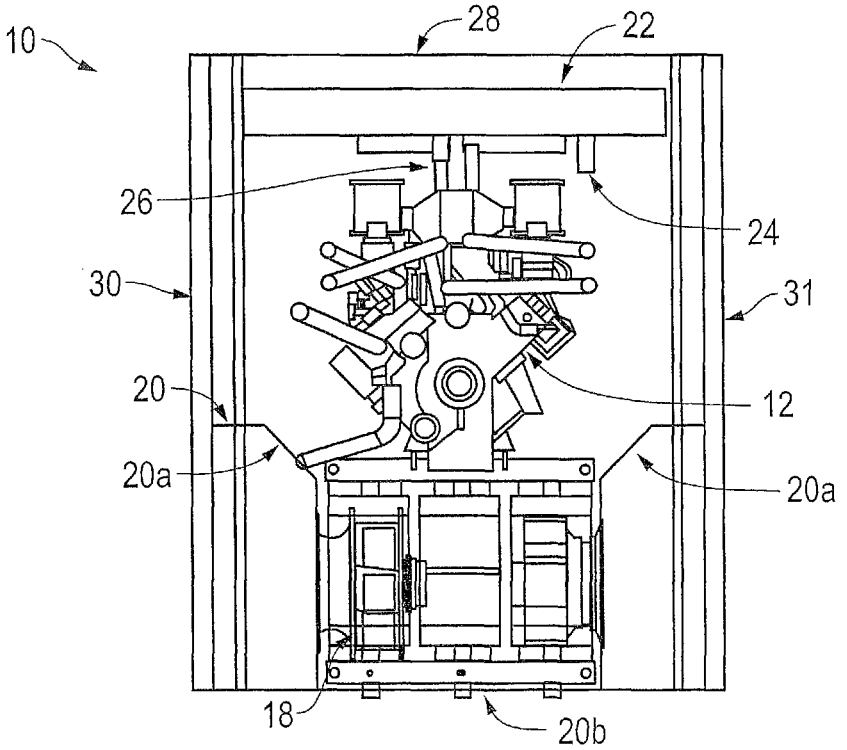
FIG. 5 is a side view of the engine generator set shown in FIG. 2.

Instead of the mechanically driven fans used in conventional generator sets, generator set 10 comprises an improved cooling system including one or more electrically driven fans 18. Unlike conventional generator sets, the electrically driven fans 18 are not mounted to the engine crank shaft (i.e., along horizontal axis 13) on either side of the engine/alternator, or between the combined engine/alternator. Instead, fans 18 are decoupled from the engine crank shaft and mounted below the combined engine/alternator within a pressurized air plenum 20, as shown in FIGS. 2-5. In addition to the air cooling provided by fans 18, the improved cooling system includes a radiator 22, which is mounted above the combined engine/alternator to provide liquid cooling to the engine. As shown in FIGS. 3-5, the radiator 22 supplies a cooling liquid (e.g., water) to engine 12 through inlet lines 24 and receives a return liquid, which has been heated by the engine, through return lines 26. In some embodiments, temperature sensors (not shown) may be included for measuring the temperature of the return liquid to ascertain engine temperature, as described in more detail below.

Figure 2:
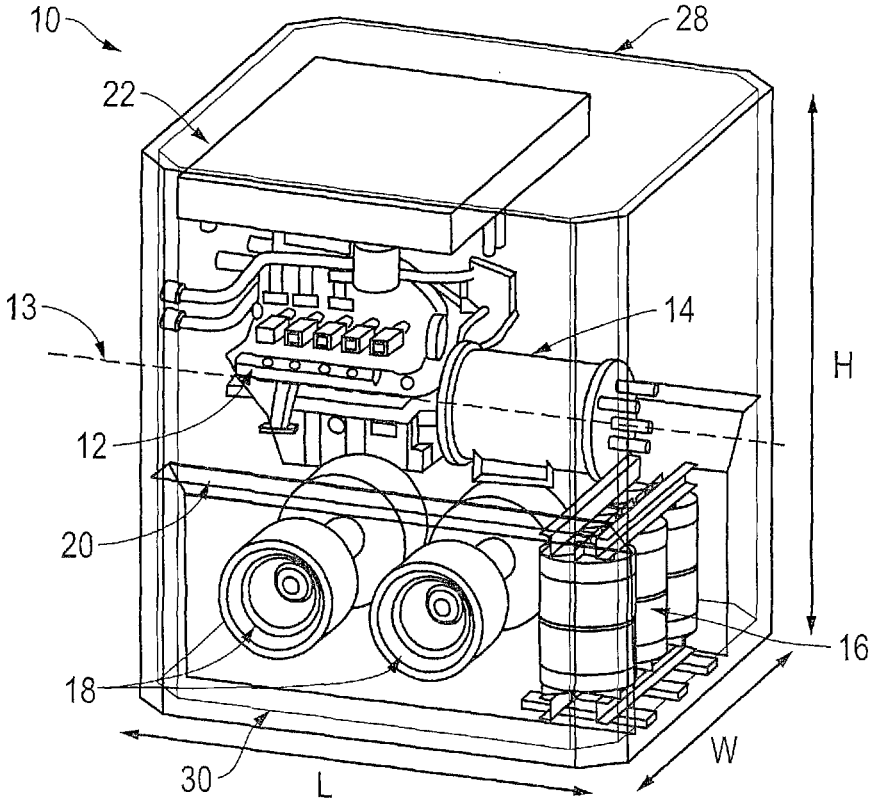
FIG. 2 is a perspective view of an improved engine generator set, according to a first embodiment.

As shown most clearly in FIGS. 2, 4 and 5, the electrically driven fan(s) 18 are mounted within air inlet(s) formed within the air plenum 20 and function to draw air, either through louvered ventilation slats (not shown) formed in the front side 30 of the generator set housing 28, and/or through openings (not shown) in the bottom surface of the generator set housing 28. In the embodiment of FIGS. 2-5, air plenum 20 extends substantially the entire length of the generator set housing 28, and comprises upper end portions 20*a* and bottom portion 20*b*. The upper end portions 20*a* are angled towards and coupled to the front side 30 and back side 31 of the generator set housing 28. The bottom portion 20 may be coupled to or resting upon the bottom surface of the generator set housing 28. The air drawn by the electrically driven fans 18 pressurizes the air plenum 20 and forces the air up and around the engine 12 and alternator 14, which are arranged within the plenum space and not simply ducted, as in many conventional designs. In some cases, louvered ventilation slats or openings (not shown) may be formed within the top surface or upper sections of the generator set housing 28 to allow the heated air to escape.

According to one embodiment, the electrically driven fan(s) 18 may be centrifugal, backward curved centrifugal or propeller type tractor or pusher type fans, although other fan types may be used in other embodiments. In some embodiments, the electrically drive fan(s) 18 may be driven by a battery source (not shown) or an external AC source (not shown). In other embodiments, the fan(s) 18 may be driven by routing a small portion of the AC current generated by the alternator 14 back to the fan(s).

The use of electrically, rather than mechanically driven fans provides several distinct advantages to the cooling system described herein. First, decoupling the fan from the engine crank shaft decouples the cooling system from the engine speed. An electrically driven fan 18 can be run to cool components within the generator set housing 28 even when the engine 12 is not running. In addition, the speed of an electrically driven fan 18 can be controlled by the temperature (and thus cooling requirements) of the engine 12, rather than the fixed speed of the engine 12.

In one example, the temperature of the liquid returning to radiator 22 from engine 12 can be measured and used to control the speed of the electrically driven fan(s) 18. One manner of doing so would be to include temperature sensor(s) within return line 26 for measuring the temperature of the heated liquid returning from engine 12 and adjusting fan speed to keep the temperature at the maximum allowable temperature for reliable engine performance. This method can maximize the efficiency of the radiator 22 by keeping the temperature differential between the cooling air flow and the coolant as high as possible. Other means may also be provided for controlling fan speed based on pre-determined set points of fan speed, which may depend on the load on the generator set and the ambient air temperature.

By enabling cooling to be optimized for engine temperature rather than engine speed, the power typically required to cool the generator set can instead be used to generate additional electrical power that can be used to power a load or be exported to a utility grid. This provides the advantage of reducing the size and cost of the generator set needed, or producing more revenues from the same sized generator set. Due to their optimized cooling, the generator sets described herein can be run up to about 105% of their rated power level. In contrast, conventional generator sets are typically restricted to less than 80% of their rated power level, due to cooling concerns.

Unlike conventional generator sets, all cooling within generator set 10 is provided by the electrically driven fan(s) 18 mounted below, and the radiator 22 mounted above, the combined engine/alternator in the embodiment of FIGS. 2-5. By removing the alternator fan typically coupled between engine 12 and alternator 14, an air gap (not shown) is formed between the engine and alternator through which cooling air is drawn into the alternator housing. In addition to cooling the alternator, the efficiency of the generator set 10 is increased by removing this fan and its associated parasitic losses. Finally, electrically driven fan(s) 18 when running at reduced speed are significantly less noisy than their mechanically driven counterparts, and therefore, inclusion of such fans decreases the overall noise level attributed to the generator set 10.

Another problem with conventional generator sets is the significant cost and time involved in engineering and installing a plurality of generator sets at an installation site. For example, two or more generator sets may be coupled in parallel at an installation site to provide a backup or temporary power source for a structure (e.g., a building or residence), campus or other facility. As noted in the background section, the output lines of each parallel coupled generator set are typically connected to a three-phase parallel electrical bus, which in turn, is connected through an automatic transfer switch (ATS) or paralleling switchgear to an electrical distribution system and/or through a main distribution panel to a customer load. The main distribution panel typically includes a single large transformer for transforming the AC voltage (e.g., 480V) output from all parallel coupled generator sets to a higher voltage (e.g., 12,470 V), which can be supplied to the loads or exported to the grid. Due to the relatively large AC currents produced by conventional generator sets (e.g., about 585 A for a 350 kW gen-set, or about 609 A for a 365 kW gen-set), relatively large and expensive cables are typically used to connect the output lines of the generator sets to the load bus or transformer at the main distribution panel.

The generator set 10 shown in FIGS. 2-5 overcomes these disadvantages by including one or more on-board transformers 16 within the generator set housing 28 for transforming the AC current and voltage output by the generator set. In general, the on-board transformers 16 may comprise groups of single phase transformers, or a single three phase transformer connected in a star or delta configuration. Although both wet type and dry type transformers may be used, dry type transformers may be preferred in some embodiments, so as to avoid the necessary containment and control of the dielectric oil used in wet type transformers.

In one embodiment, the improved generator set 10 shown in FIGS. 2-5 may be configured for generating three phase AC voltage at 480V and approximately 365 KW, and may generate approximately 609 A of AC current at the output of the alternator 14. Instead of outputting this current level to an external transformer, the AC current generated by alternator 14 is supplied to the one or more on-board transformers 16 included within the generator set housing 28. The on-board transformers 16 function to increase or "step up" the voltage generated by alternator 14, which necessarily decreases the current generated by the alternator 14 to maintain the same power output. According to one embodiment, the on-board transformers 16 may decrease the AC current level generated by alternator 14 from about 609 A to about 24 A at the output lines of a 365 KW generator set. This significantly reduces the AC current level output from the generator set 10.

Outputting a significantly lower AC current level enables significantly smaller and cheaper cables to be used when connecting the output lines of generator set 10 to the parallel electrical bus over long distances. According to one example, relatively small, class #2 cables may be used, in lieu of the larger, parallel sets of 500MCM cables required when connecting conventional generator sets of a comparable power rating (e.g., 365 KW). In addition to reducing cable size and costs, the inclusion of on-board transformer(s) 16 within the generator set housing 28 reduces the possibility that the failure of one transformer may disable all of the parallel connected generator sets. Furthermore, including transformers 16 within the generator set housing 28 enables the transformers to be cooled by the electrically driven fan(s) 18. In some embodiments, the cooling provided by the fan(s) 18 may enable physically smaller transformers 16 to be used, which do not have their own cooling fans. This may help to reduce the footprint of the generator set even further. Additionally, smaller transformers use less materials and are therefore lighter and less expensive to produce, thereby further reducing the cost of the generator set.

A second embodiment of the improved generator set 10 is illustrated in FIGS. 6-9. The embodiment shown in FIGS. 6-9 is similar to the embodiment shown in FIGS. 2-5 in that it includes an internal combustion engine 12, an alternator 14, one or more on-board transformers 16, one or more electrically driven fan(s) 18, an air plenum 20 and a radiator 22, all of which are enclosed within a generator set housing 28 having a significantly reduced footprint. The generator set housing 28 shown in FIGS. 6-9 may also be dimensioned and shaped, as discussed above.

Figure 8:
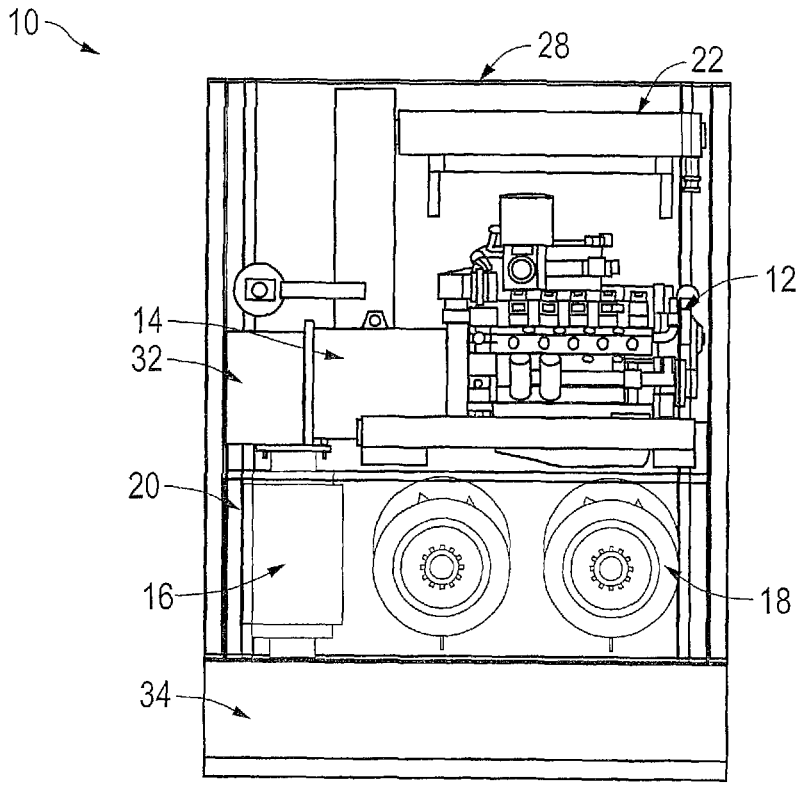
FIG. 8 is a front view of the engine generator set shown in FIG. 6.
Figure 9:
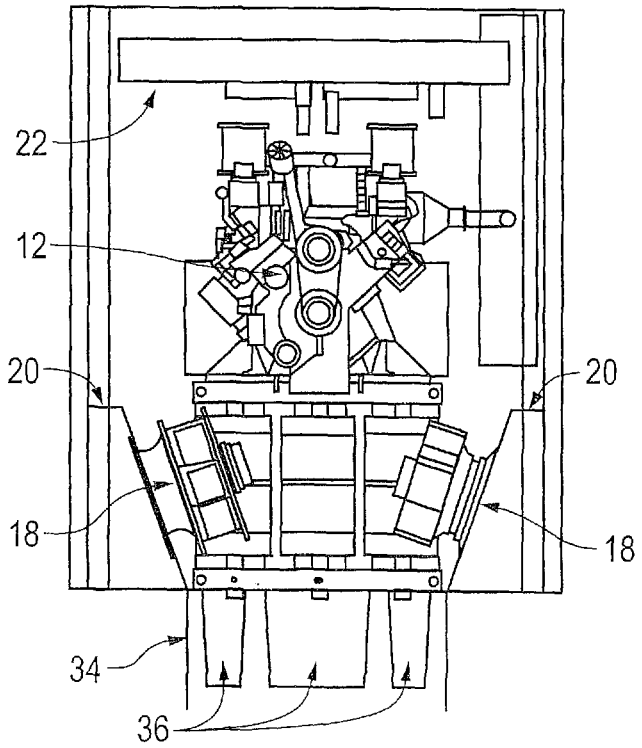
FIG. 9 is a side view of the engine generator set shown in FIG. 6.
Figure 10:
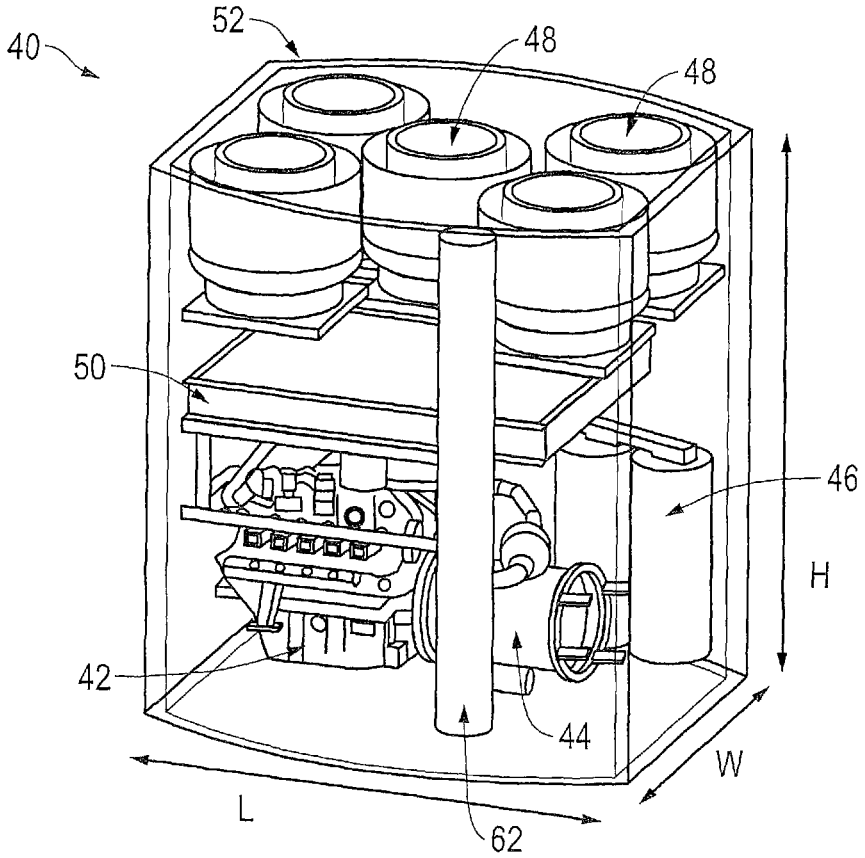
FIG. 10 is a perspective view of an improved engine generator set, according to a third embodiment.

One difference between the generator set 10 shown in FIGS. 6-9 and the generator set 10 shown in FIGS. 2-5 is the angled configuration of the air plenum 20, and the orientation of the electrically driven fans 18 housed within the angled air plenum. As shown in the comparison of FIGS. 5 and 9, sidewalls of the air plenum 20 are angled in the embodiment of FIG. 9 to make structural accommodations for some of the generator set components. Although this slightly changes the orientation of the electrically driven fans 18 mounted within the air inlets formed within the air plenum 20, the functionality of the fans 18 remains the same.

In addition to an angled air plenum 20, the generator set 10 illustrated in FIGS. 6-9 includes additional features, which are not explicitly shown in FIGS. 2-5, such as an electronic control section 32 and mounting structure 34. Although not explicitly illustrated as including such features, the generator set 10 shown in FIGS. 2-5 may also include the electronic control section 32 and/or the mounting structure 34 shown in FIGS. 6-9, in some embodiments.

In some embodiments, the electronic control section 32 may include a control panel, a controller, one or more output sensors and a parallel circuit breaker. The output of the alternator 14 is fed through the output sensors and the circuit breaker to the output lines of the generator set 10. The controller is typically a microcomputer based subsystem that executes a control program to govern the operation of the alternator 14. The controller receives signals from the control panel and the output sensors, which sense the voltage and current levels of the electricity produced by the alternator, and from those signals derives the frequency and polarity of the AC current and voltage produced by the alternator. The parallel circuit breaker operates to open and close a set of contacts that connect the output lines of the generator set 10 to an electrical distribution system or customer load.

Figure 6:
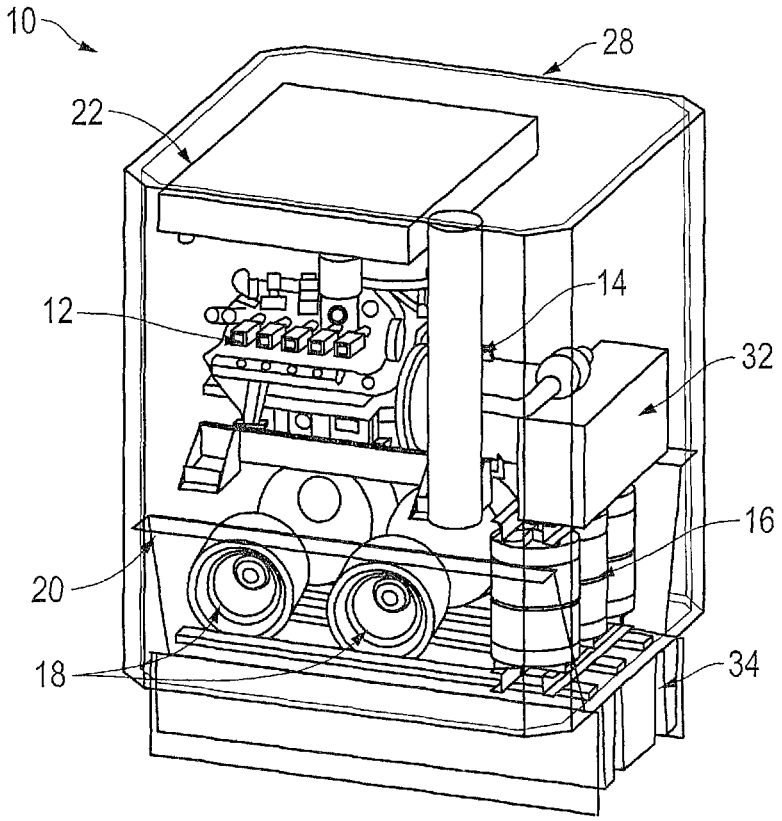
FIG. 6 is a perspective view of an improved engine generator set, according to a second embodiment.
Figure 7:
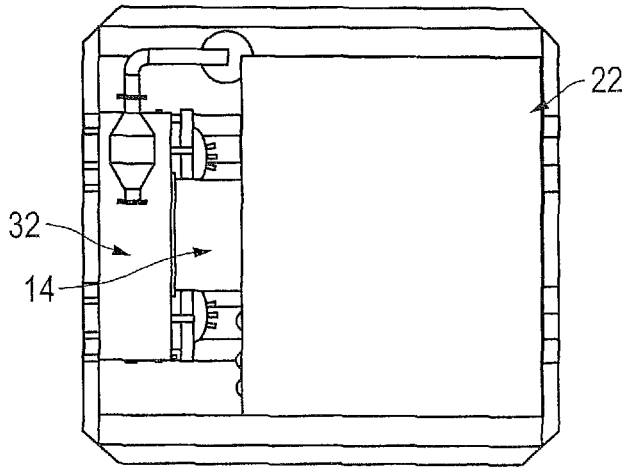
FIG. 7 is a top view of the engine generator set shown in FIG. 6.

FIGS. 6, 8 and 9 illustrate one embodiment of a mounting structure 34 for the improved generator set 10. In general, mounting structure 34 may be configured to elevate the base of the generator set 10 off the ground (or other mounting surface), so that air can be drawn into the generator set housing 28 through louvered ventilation slats or other openings (not shown) formed in or near the bottom of the generator set housing 28. The mounting structure 34 may be formed from substantially any material, and in substantially any configuration, necessary to elevate the generator set 10 off the ground and bear the weight of the generator set. Although not so limited, the mounting structure 34 may be formed, in one embodiment, by bending a metal plate of sufficient thickness into the shape shown in FIGS. 6, 8 and 9. In some embodiments, cavities or compartments 36 formed within the mounting structure 34 may be used for routing power, control and/or fuel lines to the appropriate generator set components.

FIGS. 10-13 illustrate an improved generator set 40, according to a third embodiment. Like the generator set 10 shown in FIGS. 2-9, generator set 40 offers a compact, modular design that includes an internal combustion engine 42, an alternator 44, one or more on-board transformers 46, one or more electrically driven fan(s) 48 and a radiator 50, all of which are enclosed within a generator set housing 52 having a significantly reduced footprint. In one embodiment, generator set housing 52 may be dimensioned similar to generator set housing 28 (e.g., housing 52 may have a length of about 9 feet, a width of about 8.5 feet and a height of about 12 feet), yet may comprise a different outer contour.

Figure 11:
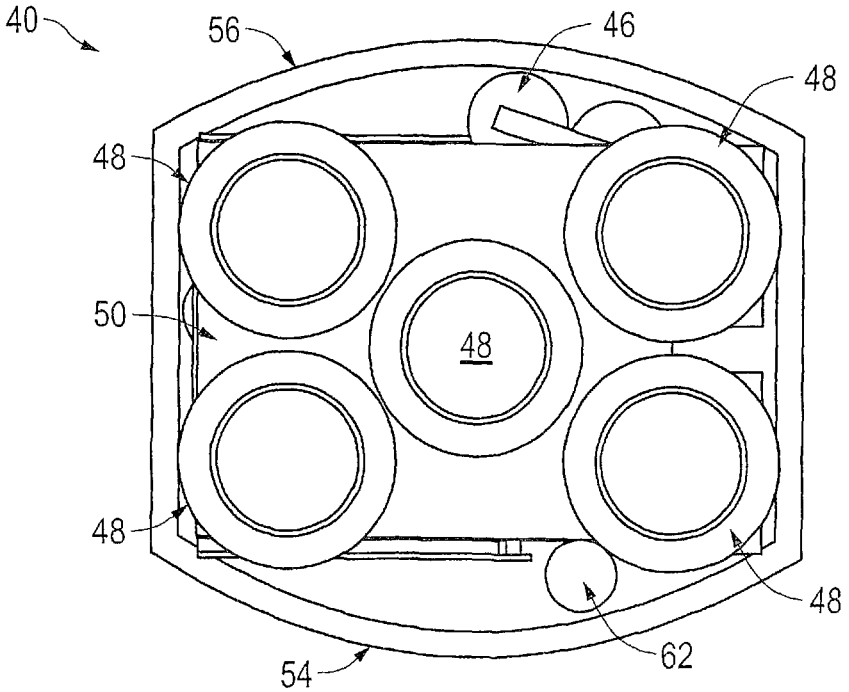
FIG. 11 is a top view of the engine generator set shown in FIG. 10.
Figure 12:
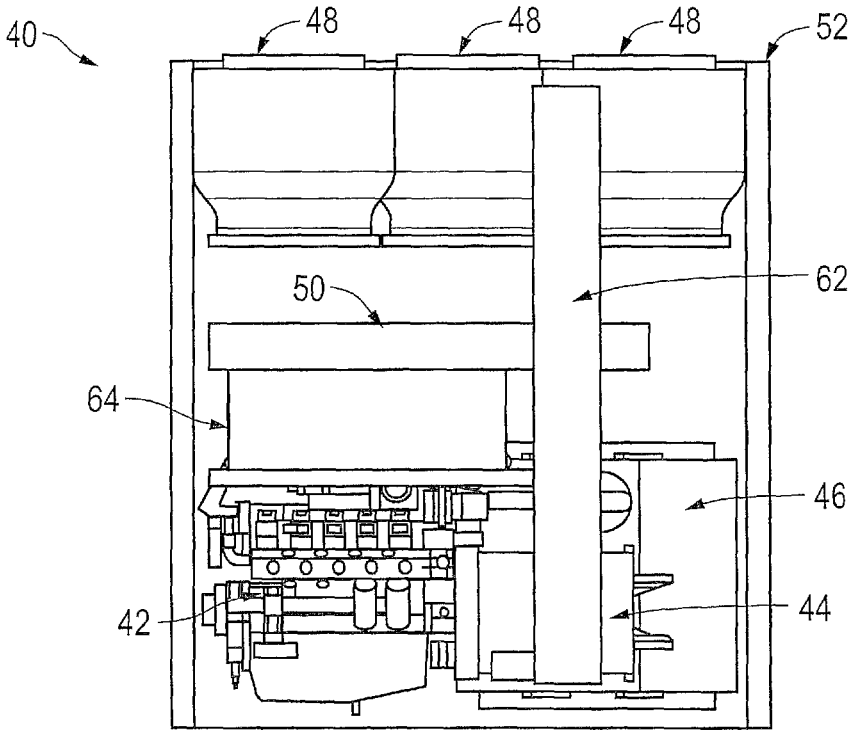
FIG. 12 is a front view of the engine generator set shown in FIG. 10.
Figure 13:
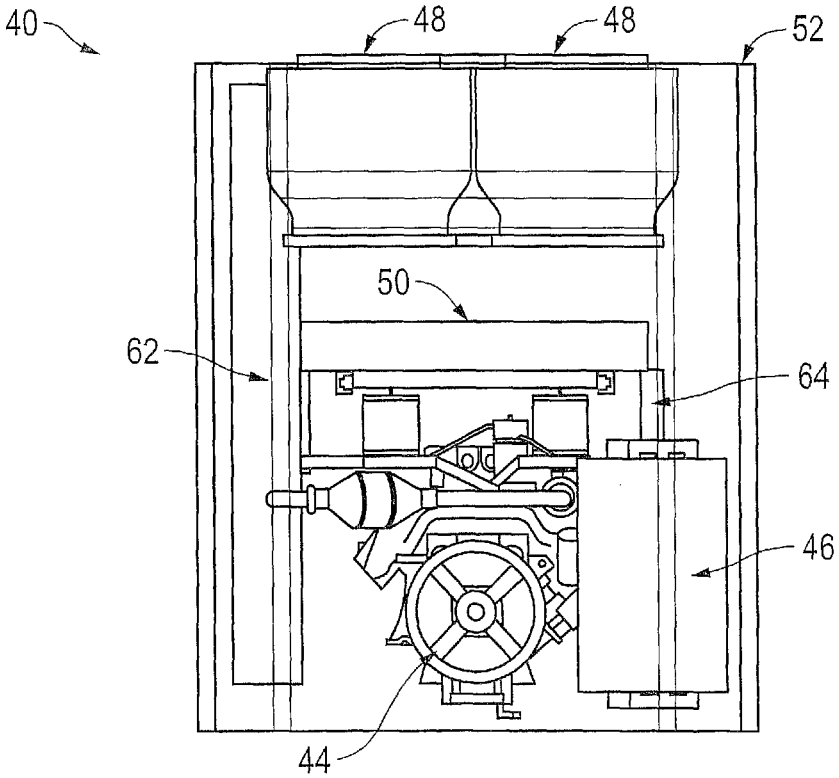
FIG. 13 is a side view of the engine generator set shown in FIG. 10.

For example, the front 54 and back 56 sidewalls of the generator set housing 52 may curve outward to accommodate components of the generator set 40, as shown most clearly in FIG. 11. Substantially different contours and dimensions may also be appropriate, as long as the generator set components are primarily stacked vertically, rather than horizontally, as in the case of conventional generator sets.

The internal combustion engine 42, alternator 44 and set of on-board transformers 46 shown in FIGS. 10-13 may generally function as described above in reference to FIGS. 2-9 to produce three-phase AC current and voltage at substantially any power rating. Although exemplary power ratings of 350 KW and 365 KW are discussed above for illustrative purposes, the improved generator sets described herein may be particularly suitable for generating AC current and voltage at a number of different power levels ranging from about 100 KW to about 3000 KW. In contrast to conventional generator sets, the inclusion of on-board transformers 46 reduces the size and cost of the cables needed to connect the generator set 40 to a parallel electric bus, and allows multiple generator sets 40 to be connected independently to the medium voltage distribution system or utility directly, which increases reliability should failures occur in any one transformer.

The primary difference between the improved generator set 40 shown in FIGS. 10-13 and the improved generator set 10 shown in FIGS. 2-9 is the arrangement and configuration of the cooling system components. In the embodiment of FIGS. 10-13, all cooling system components are mounted above the combined engine/alternator, which is mounted near the bottom of the generator set housing 52. As shown most clearly in FIGS. 12-13, radiator 50 is mounted above and coupled for supplying a cooling liquid (e.g., water) to engine 42. In some embodiments, radiator 50 may be mounted to support posts 62 and 64. Radiator 50 may generally function as described above for radiator 22, and in some embodiments, may comprise temperature sensors (not shown) within the return lines for ascertaining engine temperature.

As in the previously described embodiments, a plurality of electrically driven fans 48 may be included within the improved generator set 40 for removing heat from the generator set housing 52. Unlike the previous embodiments, however, the electrically driven fans 48 are mounted above the radiator 50 near the top of the generator set housing 52 in FIGS. 10-13, instead of below the combined engine/alternator near the bottom of the generator set housing 28 within an air plenum 20, as shown in FIGS. 2-9. Due to this arrangement, the air plenum shown in FIGS. 2-9 may or may not be omitted in the embodiment shown in FIGS. 10-13.

Although five electrically driven fans 48 are shown in the exemplary embodiment of FIGS. 10-13, it should be understood that substantially any reasonable number of electrically driven fans 48 may be used to provide cooling within the generator set housing 52. The electrically driven fans 48 may be driven with a battery source (not shown), an external AC source (not shown), or a small portion of the AC current generated by alternator 44, as discussed above. In some embodiments, the electrically driven fans 48 may be mounted to one or more support posts, such as support post 62.

The electrically driven fans 48 generally function to draw air through openings (not shown) formed in or near the bottom of the generator set housing 52, which forces air up and around engine 42 and alternator 44. In some cases, the generator set 40 may be mounted upon a mounting structure, as shown and described with respect to FIGS. 6, 8 and 9, to elevate the generator set 40 and enable air to be drawn in or near the bottom of the generator set housing 52. In some cases, louvered ventilation slats or other openings (not shown) may be formed within the top surface or upper sections of the generator set housing 52 to allow the heated air to escape. According to one embodiment, the electrically driven fan(s) 48 may be centrifugal, backward curved centrifugal or propeller type tractor or pusher type fans, although other fan types may be used in other embodiments. The use of electrically, rather than mechanically driven fans provides several distinct advantages, as noted above.

Figure 14:
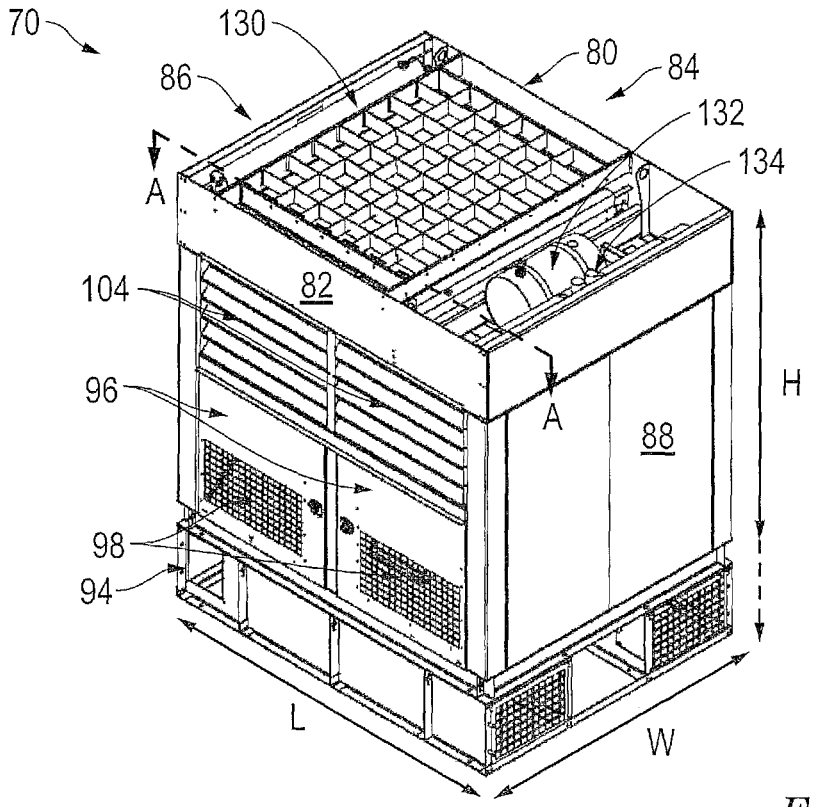
FIG. 14 is a front perspective view of an improved engine generator set, according to a fourth embodiment.
Figure 15:
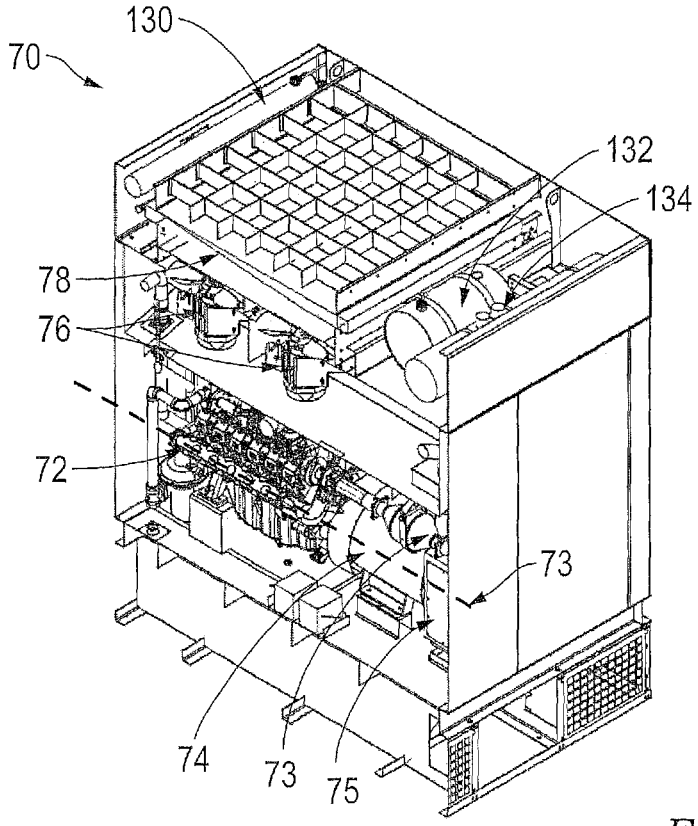
FIG. 15 is a front cross-sectional view through line A-A of the engine generator set shown in FIG. 14.
Figure 16:
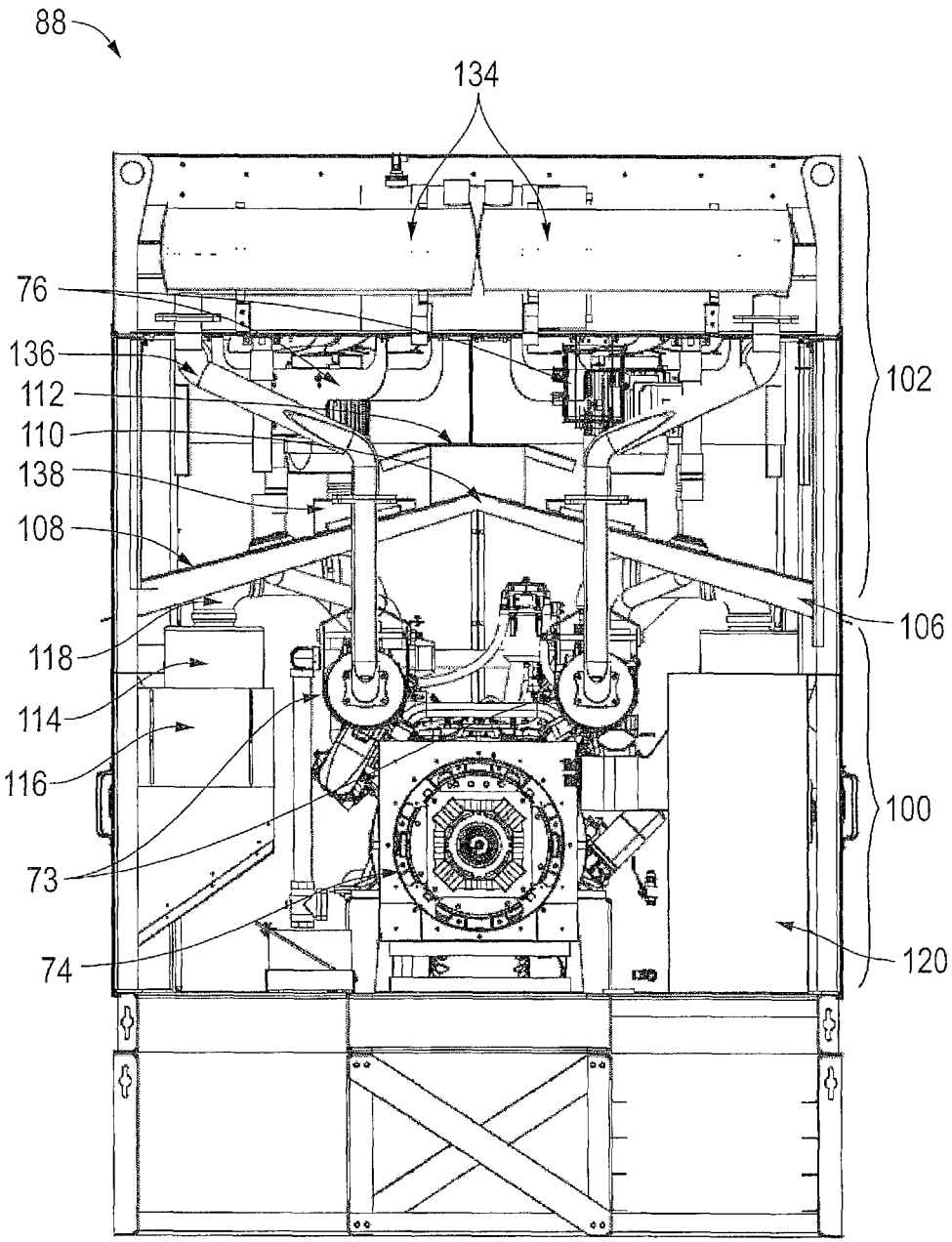
FIG. 16 is a left side view of the engine generator set shown in FIG. 14 with the left side of the generator set housing removed to provide a left-side view of the generator set components.
Figure 17:
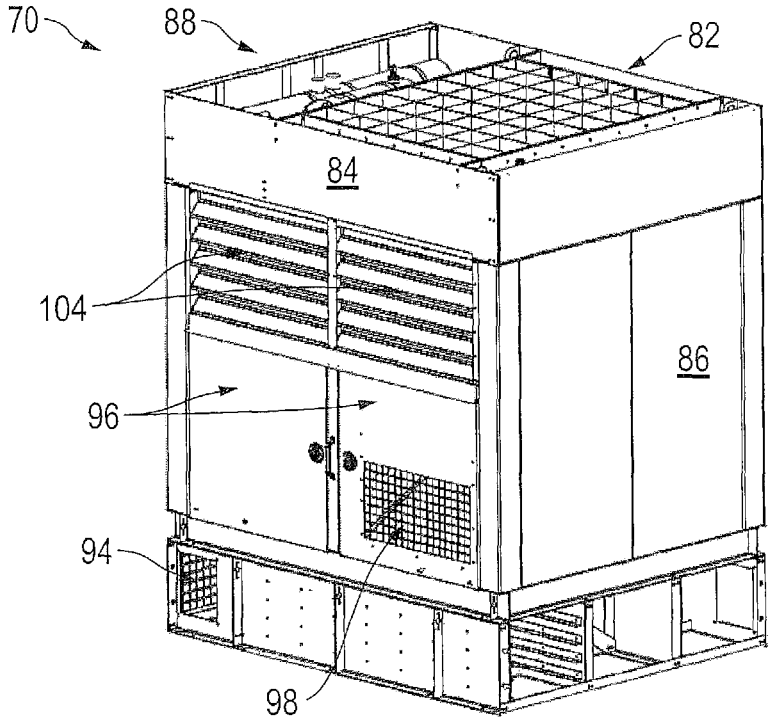
FIG. 17 is a back perspective view of the engine generator set shown in FIG. 14.
Figure 18:
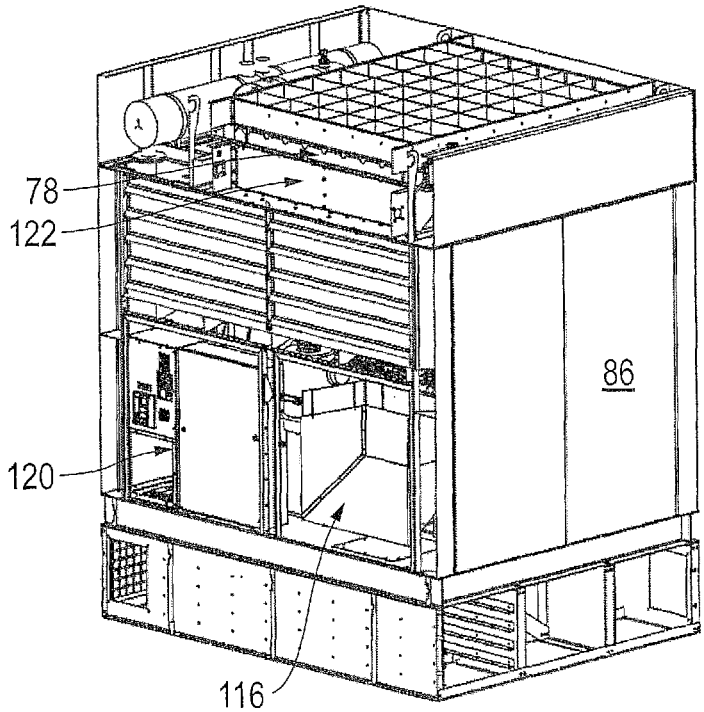
FIG. 18 is a back side view of the engine generator set shown in FIG. 14 with the back side of the generator set housing removed to provide a back-side view of the generator set components.
Figure 19:
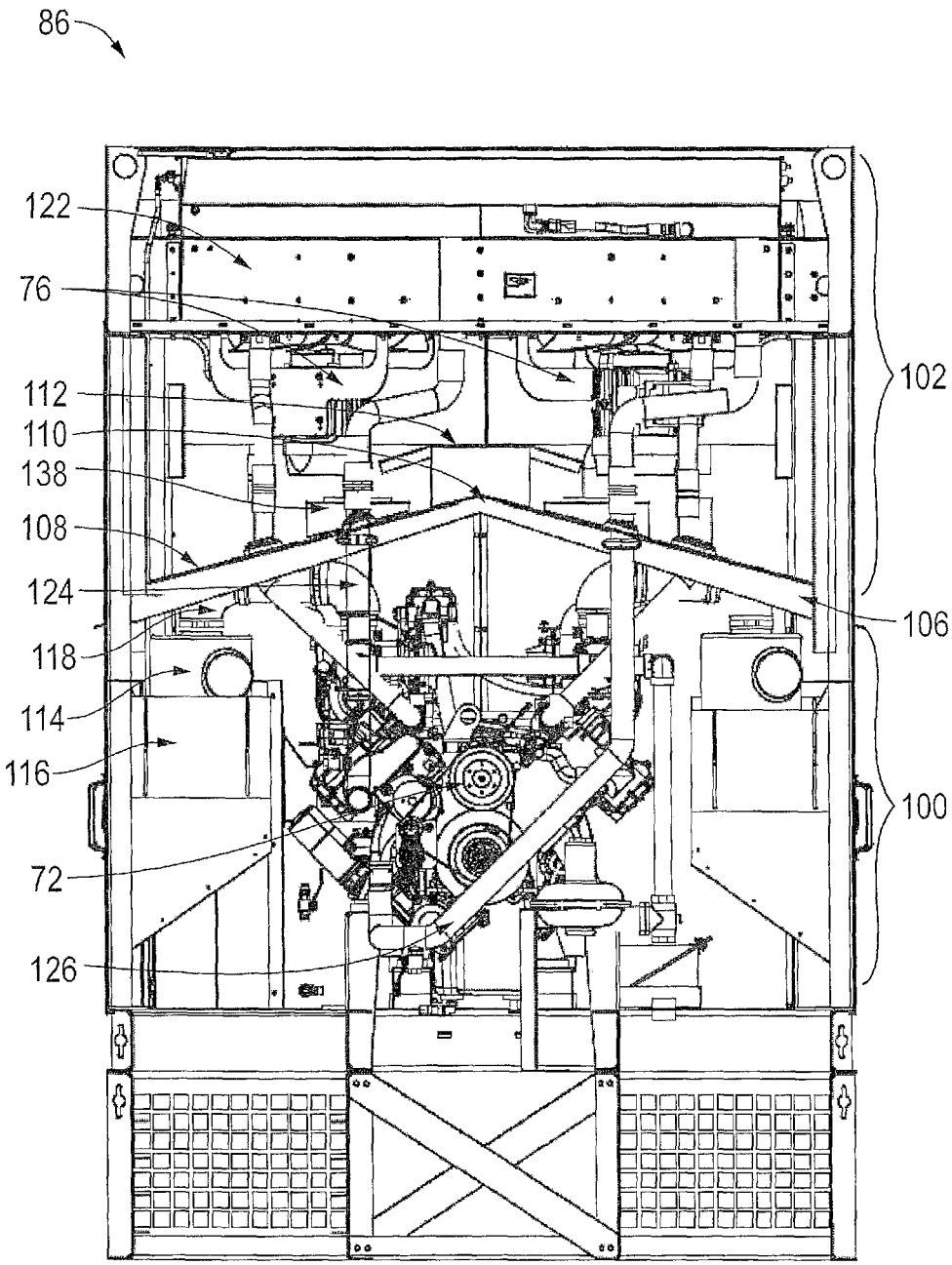
FIG. 19 is a right side view of the engine generator set shown in FIG. 14 with the right side of the generator set housing removed to provide a right-side view of the generator set components.
Figure 20:
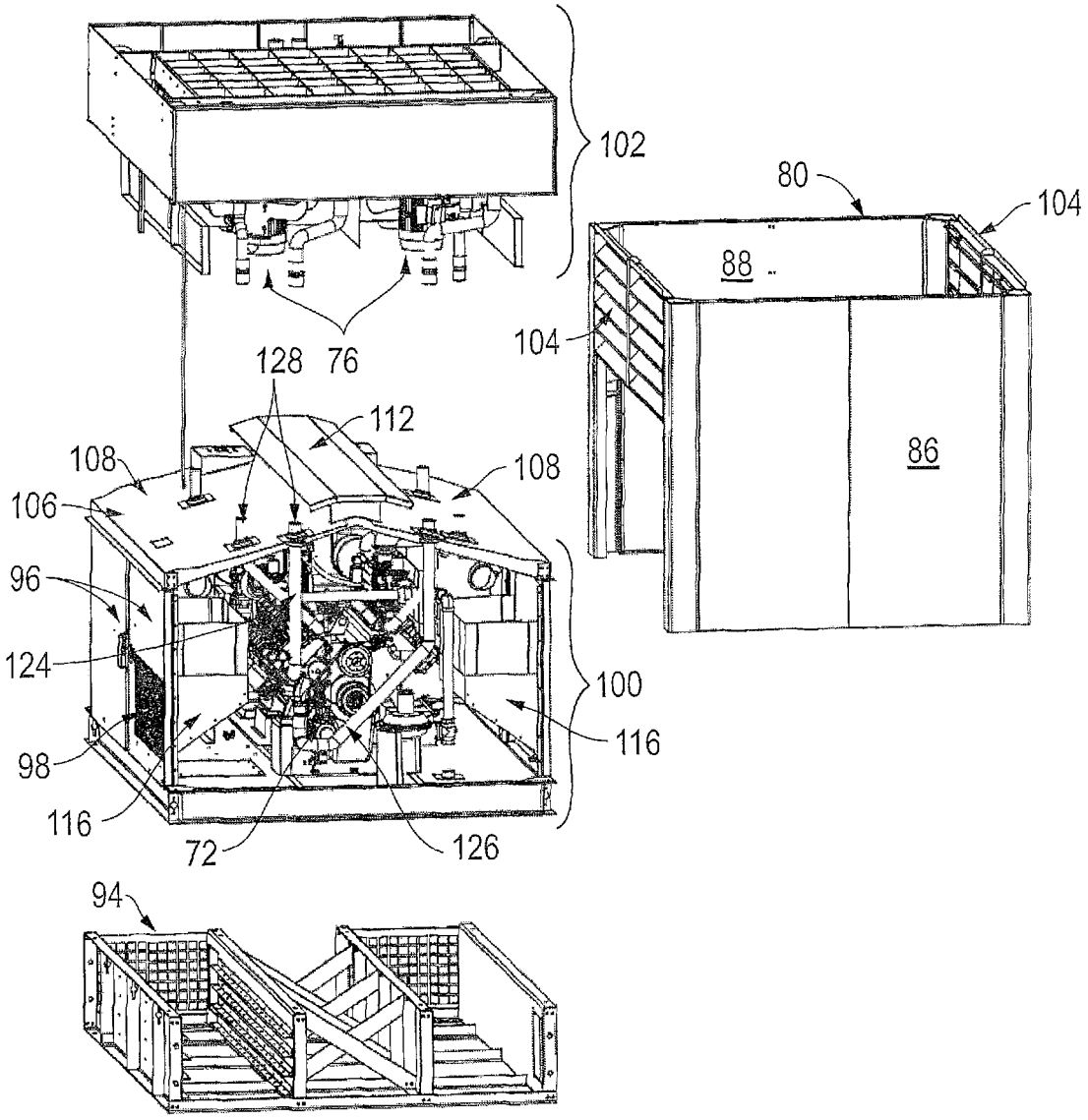
FIG. 20 is an exploded view of the modular compartments that form the engine generator set shown in FIG. 14.

FIGS. 14-20 illustrate an improved generator set 70, according to a fourth embodiment. A front perspective view of generator set 70 is illustrated in FIG. 14. A front cross-sectional view through line A-A of generator set 70 is depicted in FIG. 15. In FIG. 16, the left side 88 of the generator set housing 80 is removed to provide a left-side view of the generator set components. A back perspective view of generator set 70 is illustrated in FIG. 17. In FIG. 18, the back side 84 of the generator set housing 80 is removed to provide a back-side view of the generator set components. In FIG. 19, the right side 86 of the generator set housing 80 is removed to provide a right-side view of the generator set components. FIG. 20 provides an exploded view of some of the modular compartments that form generator set 70.

Like the previous embodiments, generator set 70 offers a compact, modular design having a significantly reduced footprint. As shown in FIGS. 15-16 and 19-20, generator set 70 may include an internal combustion engine 72, an alternator 74, one or more electrically driven fan(s) 76 and a radiator 78, all of which are enclosed within a generator set housing 80. As in the previously described embodiments, engine 72 is coupled to alternator 74, such that a crank shaft of the engine extends along a horizontal axis 73 to couple with a rotor (not shown) of the alternator to form a horizontally shafted engine and alternator. The combined engine 72 and alternator 74 may generally function as described above in reference to FIGS. 2-13 to produce three-phase AC current and voltage at substantially any power rating. Although exemplary power ratings of 350 KW and 365 KW are discussed above for illustrative purposes, generator set 70 may be particularly suitable for generating AC current and voltage at a number of different power levels ranging from about 100 KW to about 3000 KW.

In some embodiments, one or more on-board transformers (not shown) may be included within the generator set housing 80 for transforming the three-phase AC current and voltage generated by the combined engine/alternator to a substantially higher voltage/lower current level, as discussed above in the previous embodiments. In other embodiments, on-board transformers may be omitted from the generator set 70, and the three-phase AC current and voltage generated by the combined engine/alternator may be output to a three-phase parallel bus, as discussed in more detail below.

According to one embodiment, generator set housing 80 may comprise a length (L) of about 10 feet, a width (W) of about 8.5 feet and a height (H) of about 10 feet. In some embodiments, generator set housing 80 may rest upon, or be coupled to, a mounting structure 94. The mounting structure 94 may increase the height (H) of the generator set 70 to about 12 feet, in one example. Although the exact dimensions of the generator set 70 may differ in other embodiments, the height (H) of the generator set 70 may generally be equal to, or larger than, the length (L) of the generator set 70, due to the vertical stacking of the generator set components. This significantly reduces the footprint of the improved generator set 70, resulting in a more compact design.

As shown in the front and back perspective views of FIGS. 14 and 17, the shape of the generator set housing 80 may be generally described as a rectangular prism, or cuboid, having substantially planar front 82, back 84, right 86, left 88 and bottom 90 sides. The top side 92 of the generator set housing 80 may also be a planar surface, or may be more open as shown in FIGS. 14 and 17, and discussed in more detail below.

As shown in FIG. 14, the front side 82 of the generator set housing 80 may include one or more access doors 96 for providing access into an engine compartment 100 of the generator set 70. The access doors 96 may include ventilation screens, slats or other openings 98 for providing an air inlet into the engine compartment 100. Similar access doors 96 and/or ventilation openings 98 may also be provided on other sides of the generator set housing 80. For example, access doors 96 with and/or without ventilation openings 98 may be provided on the back side 84 of the generator set housing 80 to provide access and/or an air inlet into the engine compartment 100 from the back side 84, as shown in FIG. 17.

As shown in FIGS. 15-16 and 19-20, one or more electrically driven fans 76 may be mounted within a cooling compartment 102 of the generator set 70. During operation, the electrically driven fans 76 may function to cool the engine compartment 100 by drawing outside air through the ventilation openings 98 in the access doors 96. In some embodiments, generator set 70 may rest upon, or be mounted to, mounting structure 94 to elevate the generator set 70 off the ground (or other mounting surface). In such embodiments, additional ventilation (not shown) may be provided on the bottom side 90 of the generator set housing 80 to enable outside air to be drawn in through the bottom side 90 by the electrically driven fan(s) 76. The air drawn in through the bottom side 90 may provide additional cooling for the components included within the engine compartment 100.

As shown in FIGS. 14 and 17, ventilation openings 104 may be included on the front 82 and back 84 sides of the generator set housing 80 to enabled heated air from the engine compartment 100 to escape. When the electrically driven fan(s) 76 are running, heated air pulled from the engine compartment 100 is drawn into the cooling compartment 102 and vented through the ventilation openings 104 in the front 82 and back 84 sides of the generator set housing 80. Although the ventilation openings 104 are depicted as louvered slats in the illustrated embodiment, other types of openings that enable air to be vented from the cooling compartment 102 may also be used. In some embodiments, heated air from the engine compartment 100 may also be vented from the top side 92 of the generator set housing 80, if the top side 92 is left open, as shown in FIG. 14. If the top side 92 is enclosed by a planar surface (e.g., to provide protection from weather), the heated air may be vented primarily through the ventilation openings 104 in the front 82 and back 84 sides of the generator set housing 80.

One difference between the generator set 70 shown in FIGS. 14-20 and the generator sets 10, 40 shown in FIGS. 2-13 is the separation of the cooling compartment 102 from the engine compartment 100 a vented partition 106. One embodiment of the vented partition 106 is shown in the left side 88 view (FIG. 16), right side 86 view (FIG. 19) and exploded view (FIG. 20) of the generator set 70.

As shown in FIGS. 16, 19 and 20, vented partition 106 separates the engine compartment 100 from the cooling compartment 102 of generator set 70. In one embodiment, vented partition 106 includes a pair of inclined planar sides 108, which may extend substantially from an inner surface of the right side 86 to an inner surface of the left side 88 of the generator set housing 80. The inclined planar sides 108 may also extend at some inclination or angle (e.g., approximately 5°-20° from the horizontal) from inner surfaces of the front 82 and back 84 sides of the generator set housing 80 to meet at central ridge 110. Openings within central ridge 110 enable heated air from the engine compartment 100 to be drawn into the cooling compartment 102 by the electrically driven fan(s) 76. As noted above, this heated air may be vented from the cooling compartment 102 through ventilation openings 104, and in some cases, through the top side 92 of the generator set housing 80. In some embodiments, a ridge vent 112 may cover and run the length of ridge 110 to protect the engine compartment 100 from ingress of water (or other debris) when the top side 92 of the generator set housing 80 is left open, as shown in FIG. 14. However, a ridge vent 112 may not be needed, and thus, may be omitted when the top side 92 is enclosed by a planar surface.

Separating the cooling compartment 102 from the engine compartment 100 provides several advantages. For example, covering the engine compartment 100 with vented partition 106 protects the engine from weather or other debris that may enter the cooling compartment 102 of the generator set 70. The vented partition 106 may also protect the engine from condensation or coolant leaks from the cooling compartment 102. Should any generator set components need maintenance or repair, the modularity afforded to the generator set housing 80 by the vented partition 106 also enables the cooling compartment 102 to be separated and removed from the engine compartment 100. This modularity is demonstrated most clearly in FIG. 20 and represents another distinction of the generator set 70 shown in FIGS. 14-20 over the generator sets 10, 40 shown in FIGS. 2-13.

FIG. 20 depicts the generator set 70 divided into four modular components: cooling compartment 102, engine compartment 100, mounting structure 94 and generator set housing 80. These components may be shipped to a customer separately, or may be combined in some fashion for shipment. In one embodiment, cooling compartment 102, engine compartment 100 and generator set housing 80 may be combined and shipped to a customer as a unit, and optional mounting structure 94 may be shipped separately. In another embodiment, engine compartment 100 and generator set housing 80 may be combined and shipped to a customer as a unit, and cooling compartment 102 and mounting structure 94 may be shipped separately. By shipping the mounting structure 94 separately, electrical wires may be run through the mounting structure 94 before the remaining generator set components are placed on top, thereby rendering installation easier.

Exemplary components that may be included within the separate engine and cooling compartments 100 and 102 will now be described with reference to FIGS. 15-16 and 18-20. As shown in FIGS. 15, 16 and 19, engine compartment 100 may include the horizontally shafted engine 72 and alternator 74, in addition to other components that control and/or aid the function of the engine/alternator. The cooling compartment 102, on the other hand, may include components designed to cool and/or provide lubrication to components within the engine compartment 100.

As shown in FIGS. 16 and 18-20, for example, engine compartment 100 may include one or more air filters 114 arranged within one or more air plenums 116. Air filter(s) 114 may be coupled for supplying filtered air to engine 72 via air intake pipe(s) 118. Air plenum(s) 116 may be coupled to an inside surface of the generator set housing 80 adjacent to the ventilation opening(s) 98 in the engine compartment 100, and may be generally configured to receive and surround the air filter(s) 114. In this manner, the air plenum(s) 116 may ensure that cooler, outside air is drawn into the engine 72 via air filter(s) 114 and air intake pipe(s) 118, as opposed to the significantly hotter air from the engine compartment 100.

In the illustrated embodiment, three air filters 114 are included within engine compartment 100, and each air filter is arranged within a separate air plenum 116. The air plenums 116 are attached to inside surfaces of the access doors 96 on the front 82 and back 84 sides of the generator set housing 80. The air plenums 116 are centered around the ventilation openings 98 included within the access doors 96, and are large enough to receive the air filters 114, yet small enough to limit the amount of heated air that is pulled into the air filter from the engine compartment 100. According to one embodiment, air plenum 116 may be implemented as a three-sided box having an angled bottom and open top, which is configured to receive air filter 114. The open fourth side of the air plenum 116 may be attached to the inside surface of the access door 96 by any mechanical means. Although air plenums 116 could be attached to other inside surfaces of the generator set housing 80 in the vicinity of other ventilation openings, attaching the air plenums 116 to the access doors 96 provides easy access to the air filters 114 for maintenance purposes.

As shown in FIGS. 16-18, engine compartment 100 may also include an electronic control section 120 for controlling the operation of the generator set 70. In some embodiments, electronic control section 120 may be arranged behind and adjacent to an access door 96, which may or may not have ventilation openings. Although the electronic control section 120 may be arranged elsewhere, arranging the electronic control section 120 adjacent to an access door 96 provides easy access to the electronic control section 120.

As noted above in the previous embodiments, the electronic control section 120 may include a control panel, a controller, one or more output sensors and a parallel circuit breaker. The output of the alternator 74 is fed through the output sensors and the circuit breaker to the output lines of the generator set 70. The controller is typically a microcomputer based subsystem that executes a control program to govern the operation of the alternator 74. The controller receives signals from the control panel and the output sensors, which sense the voltage and current levels of the electricity produced by the alternator, and from those signals derives the frequency and polarity of the AC current and voltage produced by the alternator. The parallel circuit breaker operates to open and close a set of contacts that connect the output lines of the generator set 70 to an electrical distribution system or customer load.

As shown in FIG. 14, engine compartment 100 may also include catalytic converters 73 and on-board batteries 75. Catalytic converters 73 may be coupled for receiving exhaust gases from engine 72, and may be configured for converting the exhaust gases into harmless bi-products (e.g., water and carbon dioxide). On-board batteries 75 may be configured for starting engine 72.

As shown in FIGS. 15-16 and 18-19, cooling compartment 102 may include one or more electrically driven fans 76, which are mounted above vented partition 106 and below radiator 78. In the embodiment of FIGS. 14-20, the electrically driven fans 76 are arranged on the exhaust side of the engine, as opposed to the air intake side. The electrically driven fans 76 are configured to pull heated air from the engine compartment 100 through the vented partition 106. The heated air is vented from the cooling compartment 102 through ventilation openings 104 and/or through the top side 92 of the generator set housing 80, as discussed above.

In one embodiment, four electrically driven fans 76 may be included within the cooling compartment 102. However, it should be noted that substantially any reasonable number of electrically driven fans 76 may be included within the cooling compartment 102 of the generator set housing 80. As noted above, electrically driven fans 76 may be driven with a battery source (not shown), an external AC source (not shown), or a small portion of the AC current generated by alternator 74. According to one embodiment, the electrically driven fan(s) 76 may be centrifugal, backward curved centrifugal or propeller type tractor or pusher type fans, although other fan types may be used in other embodiments.

The use of electrically, rather than mechanically driven fans provides several distinct advantages. As noted above, decoupling the fan from the engine crank shaft decouples the cooling system from the engine speed. This enables the electrically driven fans 76 to be driven even when the engine 72 is not running, and enables the speed of the electrically driven fans 76 to be controlled by the temperature (and thus cooling requirements) of the engine 72, rather than the fixed engine speed.

In addition to the air cooling provided by fans 76, cooling compartment 102 includes a radiator 78, which is coupled to provide liquid cooling to engine 72. As shown in FIGS. 18-19, radiator 78 may be supported by radiator mounting bracket 122. As shown in FIGS. 16 and 19-20, radiator 78 is coupled for supplying a cooling liquid (e.g., water or other coolant) to engine 72 through inlet lines 124, and is further coupled for receiving a return liquid, which has been heated by the engine, through return lines 126. The inlet lines 124 and return lines 126 may pass through the vented partition 106 separating the cooling compartment 102 and engine compartment 100. As shown most clearly in FIG. 20, seals 128 may be provided (e.g., gaskets, o-rings, flanges, etc.) for sealing the orifices through which the inlet lines 124 and return lines 126 pass through the vented partition 106. If included, seals 128 may ensure that water or other debris does not enter the engine compartment 100.

In some embodiments, the temperature of the liquid returning to radiator 78 from engine 72 can be measured and used to control the speed of the electrically driven fan(s) 76. One manner of doing so would be to include temperature sensor(s) within return line 126 for measuring the temperature of the heated liquid returning from engine 72 and adjusting fan speed to keep the temperature at the maximum allowable temperature for reliable engine performance. This method can maximize the efficiency of the radiator by keeping the temperature differential between the cooling air flow and the coolant as high as possible. Other means may also be provided for controlling fan speed based on predetermined set points of fan speed, which may depend on the load on the generator set and the ambient air temperature. By enabling cooling to be optimized for engine temperature rather than engine speed, the power typically required to cool the generator set can instead be used to generate additional electrical power that can be used to power a load or be exported to the grid. This provides the advantage of reducing the size and cost of the generator set needed, or producing more power/revenues from the same sized generator set.

Other components may also be included within the cooling compartment 102. As shown in FIGS. 14-15, for example, cooling compartment 102 may include a coolant expansion tank 130, oil make up tank 132 and exhaust silencers 134. These components may be mounted on the top side 92 of the generator set housing 80, as shown in FIGS. 14-15, or may be enclosed within a planar surface (not shown) in other embodiments. The coolant expansion tank 130 may contain and be coupled to provide water (or other coolant) to radiator 78. The oil make up tank 132 may contain and be coupled to provide oil to engine 72. The exhaust silencers 134 may be coupled to catalytic converters 73 for further reduction in the noise emitted. As shown in FIG. 16, catalytic converters 73 are coupled to exhaust silencers 134 via exhaust pipes 136, which pass through vented partition 106. Similar to inlet and outlet lines 124/126, seals 138 may be provided (e.g., gaskets, o-rings, flanges, etc.) for sealing the orifices through which the exhaust pipes 136 pass through the vented partition 106. If included, seals 138 may ensure that water or other debris does not enter the engine compartment 100.

Figure 21:
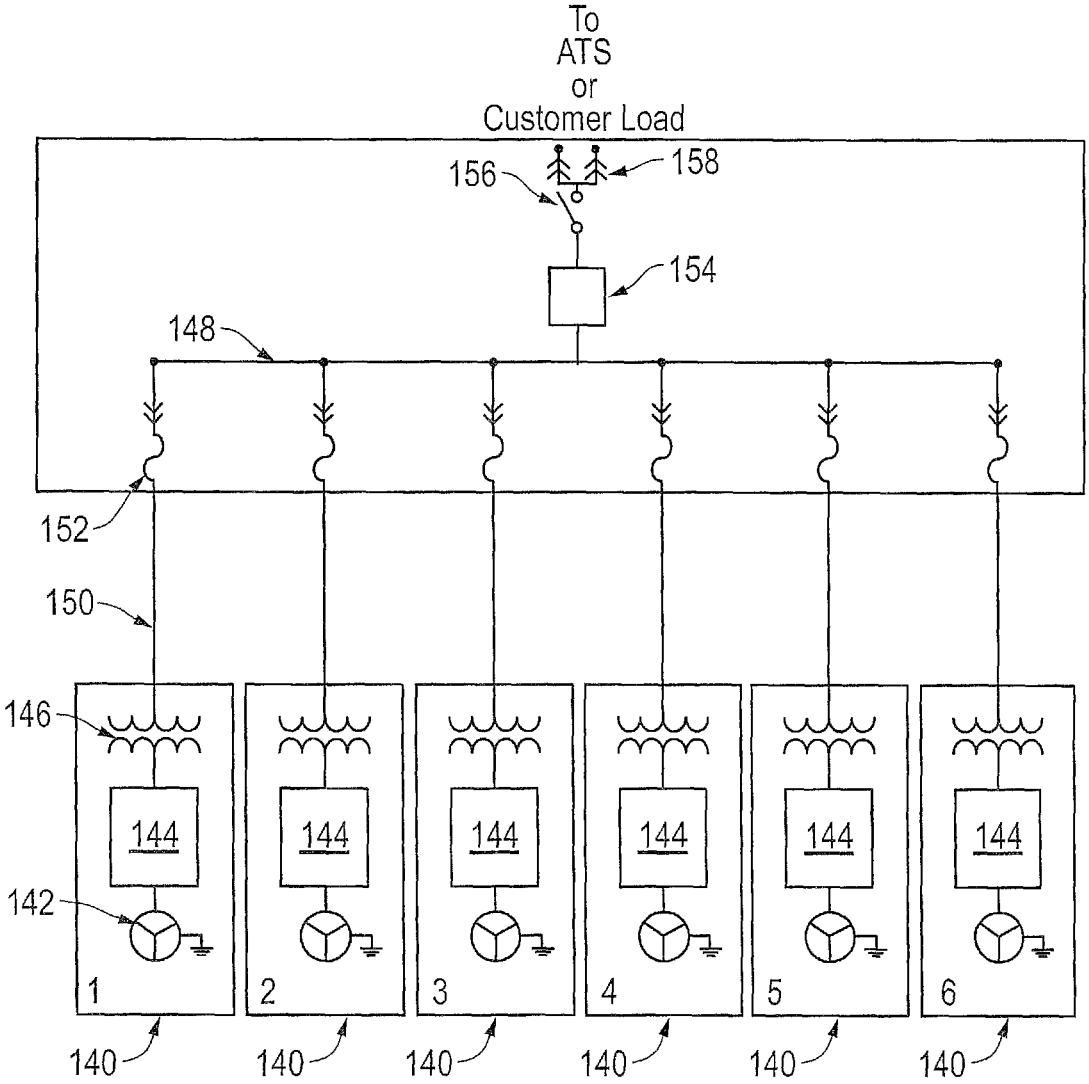
FIG. 21 is a circuit diagram illustrating how a number of the engine generator sets shown and described herein may be coupled in parallel, according to one embodiment.

As noted above, a plurality of the generator sets (10, 40 or 70) described herein may be electrically coupled together in parallel to provide a back-up or temporary generation system or power source. FIG. 21 is an electrical diagram illustrating six of the generator sets (10 or 40) shown in FIGS. 2-13 coupled in parallel to produce a "paralleling system" or parallel-coupled generation system. Although a particular number of generator sets are paralleled in the embodiment shown in FIG. 21, it is noted that any number of generator sets could be alternatively coupled in parallel to form a parallel set or cluster. In some embodiments, a plurality of parallel sets or clusters (each comprising any number of parallel coupled generator sets) may be further coupled in a ring bus or branch configuration to meet the needs of a particular installation site.

In the exemplary generation system shown in FIG. 21, six generator sets 140 each comprising generation components 142, electronic control section 144 and on-board transformers 146 are depicted. Generally speaking, generation components 142 may include the components responsible for generating electricity (e.g., the engine, alternator, etc.), and the electronic control section 144 may include the components responsible for controlling the generation of electricity, as well as connecting/disconnecting the generated electricity from the output lines. On-board transformers 146 are included within generator sets 140 for converting the three-phase AC current and voltage generated by the generation components 142 (e.g., about 480V/609 A for a 365 kW generator set) to a substantially higher voltage/lower current level (e.g., about 12.47 kV/24 A for a 365 kW generator set).

In the exemplary generation system shown in FIG. 21, the output lines of each generator set 140 are coupled to a three-phase parallel electrical bus 148 by a plurality of cables 150 and connectors 152. As noted above, the inclusion of on-board transformers 146 enables smaller cables 150 to be used, which reduces installation costs. According to one embodiment, cables 150 may each comprise a set of three #2 15 KV shielded cables with 16.2 A current in each, although wire size and classification may differ substantially in other embodiments. The cables 150 are connected by connectors 152 (e.g., 15 KV fused elbow connectors) to the parallel electrical bus 148, which in turn, is connected to a bus breaker 154. The bus breaker 154 may be connected through a break switch 156 and connector 158 to an automatic transfer switch (ATS) or a customer load. The entire parallel set (i.e., all of generator sets 70140) may be manually or automatically connected/disconnected to/from the ATS or customer load through break switch 156. On the other hand, individual generator sets 140 may be connected/disconnected to/from the parallel set via connectors 152, depending on load requirements or faults.

Figure 22:
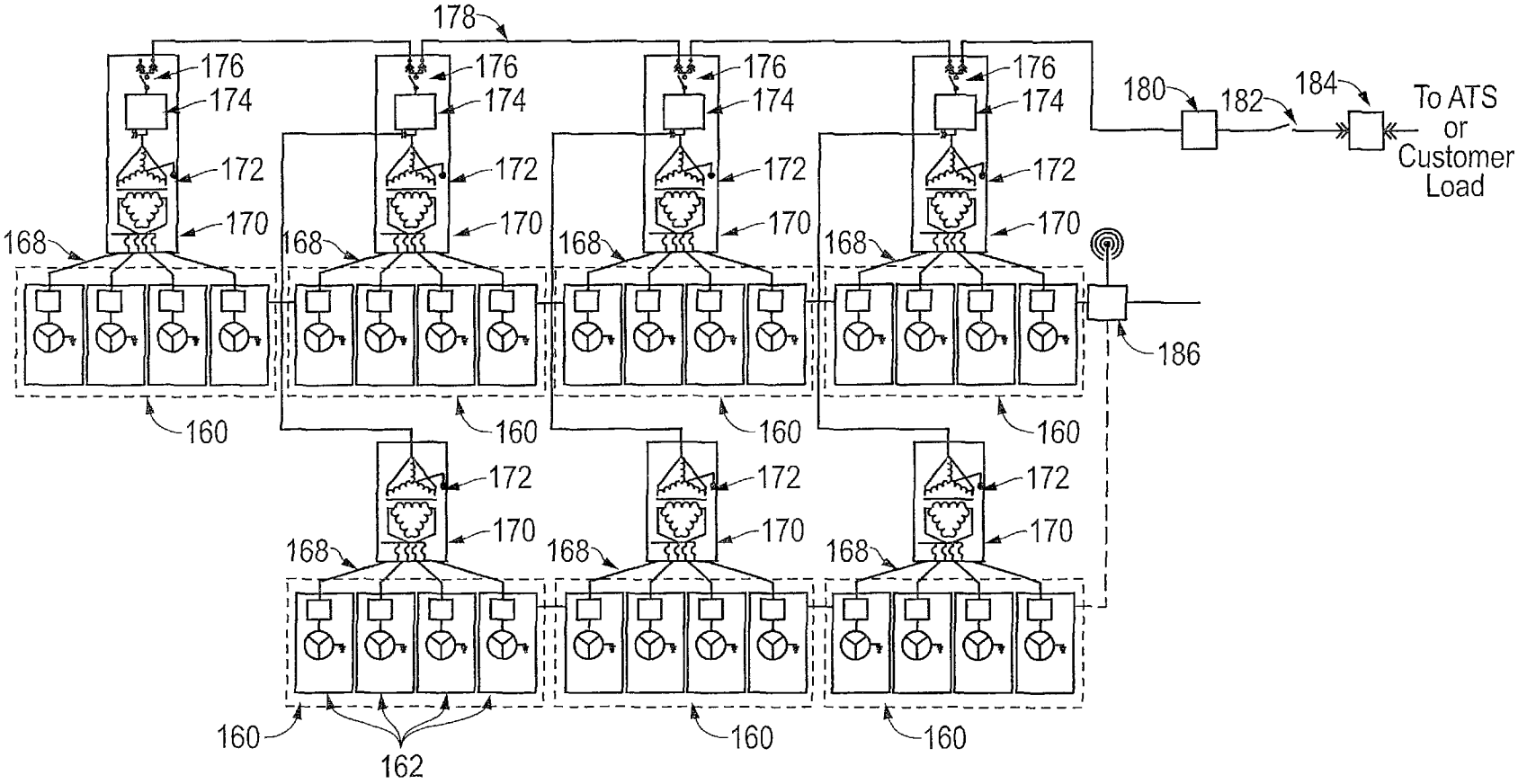
FIG. 22 is a circuit diagram illustrating how a number of the engine generator sets shown and described herein may be coupled in parallel, according to another embodiment.

FIG. 22 provides an exemplary electrical diagram for a paralleling system or parallel-coupled generation system, according to another embodiment. The exemplary generation system shown in FIG. 22 includes seven clusters 160 of parallel-coupled generator sets 162, and each cluster 160 comprises four parallel-coupled generator sets 162. Although a particular number of generator sets and clusters are depicted in the embodiment shown in FIG. 22, it is noted that any number of generator sets 162 could be coupled in parallel to form a parallel set or cluster 160, and any number of clusters 160 may be coupled in parallel (or in a branch or ring bus configuration) to form a generation system capable of meeting the needs of a particular installation site.

In the exemplary generation system shown in FIG. 22, each generator set 162 may include the generation components 164 responsible for generating electricity (e.g., the engine, alternator, etc.), and the electronic control section 166 responsible for controlling the generation of electricity, as well as connecting/disconnecting the generated electricity from the output lines. Unlike the previous example, on-board transformers are not included within the generator sets 162 shown in FIG. 22. In this embodiment, an external transformer 172 is provided for transforming the AC current and voltage generated by each cluster 160 of generator sets 162. The generator sets 162 within a given cluster 160 are coupled to a respective transformer 172 via output cables 168 and connectors 170.

According to one embodiment, the three-phase AC voltage and current generated by each generator set 162 may be about 480V and 609 A for a 365 kW generator set. In such an embodiment, output cables 168 may each comprise a set of two 500MCM for each of the three phases, although wire size and classification may differ substantially in other embodiments. Although substantially larger and more expensive than the #2 15 KV shielded cables used in the previous embodiment, the length and use of output cables 168 may be minimized in some embodiments by arranging the external transformers 172 as close as possible to each cluster 160 of parallel-coupled generator sets 162. The output cables 168 from each cluster 160 are connected to a dedicated transformer 172 via connectors 170 (e.g., medium voltage load break elbow connectors). The connectors 170 enable individual generator sets 162 to be connected/disconnected to/from the transformer 172, depending on load requirements or faults. The external transformers 172 dedicated to each cluster 160 may transform the AC voltage and current generated by each cluster 160 of generator sets 162 into a substantially higher voltage and lower current.

In some embodiments, a plurality of bus breakers 174 and connectors 176 may be used to connect the output of each transformer 172 to a parallel bus 178. In the illustrated example, four bus breakers 174 and four connectors 176 are used for coupling the transformed outputs of the seven clusters 160 to the parallel bus 178. Three of the bus breakers 174 (e.g., bus breakers 1-2, 3-4 and 5-6) are each coupled for receiving the transformed outputs from two parallel-coupled clusters 160, and one of the bus breakers 174 (e.g., bus breaker 7) is coupled for receiving the transformed output from only one cluster 160. In other embodiments, separate bus breakers 174 and connectors 176 may be used for connecting the transformed output of each cluster 160 to the parallel bus 178. Alternatively, fewer bus breakers 174 and connectors 176 may be used (e.g., 2), and a greater number of clusters 160 (e.g., 3-4) may be coupled to each bus breaker.

As noted above, the parallel bus 178 of the generation system may be coupled to an automatic transfer switch (ATS) or a customer load. In the illustrated embodiment, the parallel bus 178 is coupled to the ATS or customer load via a generation circuit breaker 180, generation isolation switch 182 and generation meter 184. The generation circuit breaker 180 allows for isolation of the generation system in case of faults or anomalies on the connected utility lines. Isolation switch 182 enables the entire generation system to be manually or automatically connected/disconnected to/from the ATS or customer load. The generation meter 184 is used to record the energy and power produced by the generation system for economic settlement. In some embodiments, a generation master controller (GMC) 186 may be coupled between the generation circuit breaker 180 and the electronic control section 166 of each generator set 162. GMC 186 may be configured for controlling the paralleling to the utility and load sharing of each generator set.

Figure 23:
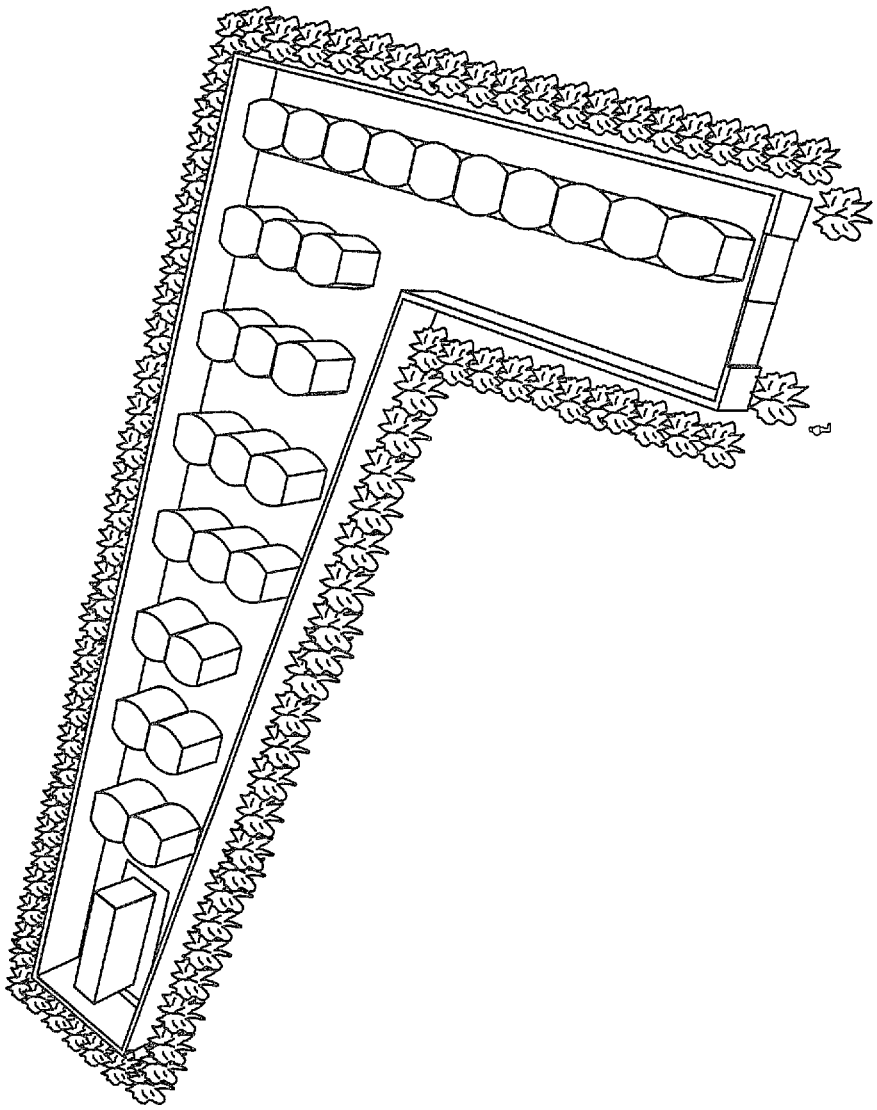
FIG. 23 is a rendering of an exemplary installation of a plurality of engine generator sets within an oddly shaped installation site.

The electrical diagrams shown in FIGS. 21-22 provide just a few examples of paralleling systems, or parallel-coupled generation systems, comprising different numbers and configurations of generator sets and clusters of generator sets. As noted above, substantially any number of generator sets and substantially any number of clusters may be coupled together to provide a generation system that meets the needs of a particular installation site. Although a particular installation site may require a large number of generator sets to be electrically coupled in parallel, as shown in the exemplary embodiments of FIGS. 21 and 22, the compact, modular design of the improved generator sets described herein enables the generator sets to be physically arranged in unique configurations to fit within the boundaries of the installation site. FIG. 23 illustrates one such unique arrangement of generator sets, where an oddly shaped piece of land was chosen as the installation site. Due to the decreased footprint and modularity provided by the improved generator sets (10, 40 and 70) described herein, a paralleling system for the oddly shaped installation site was provided with significantly greater standby power than would have been possible with parallel sets of conventional generator sets.

It will be appreciated to those skilled in the art having the benefit of this disclosure that this invention is believed to provide improved generator sets with a more compact, modular design and improved cooling characteristics. Further modifications and alternative embodiments of various aspects of the invention will be apparent to those skilled in the art in view of this description. It is intended, therefore, that the following claims be interpreted to embrace all such modifications and changes and, accordingly, the specification and drawings are to be regarded in an illustrative rather than a restrictive sense.

What is claimed is:

1. An engine generator set, comprising:

an engine compartment comprising an internal combustion engine coupled to an alternator, such that a crank shaft of the internal combustion engine extends along a horizontal axis of the internal combustion engine to couple with a rotor of the alternator to form a horizontally shafted engine and alternator;

a cooling compartment comprising one or more cooling system components mounted above and/or below the horizontally shafted engine and alternator;

a generator set housing enclosing the engine compartment and the cooling compartment, wherein the height of the generator set housing is equal to or larger than the length of the generator set housing, and wherein the length is substantially parallel to the horizontal axis;

one or more air filters arranged inside the engine compartment and coupled to supply filtered air to the internal combustion engine via one or more air intake pipes; and one or more air plenums arranged inside the engine compartment, wherein each air plenum is implemented as a three-sided box having an angled bottom and open top, wherein the open top is configured to receive one of the one or more air filters, and wherein an open fourth side of the three-sided box is attached to an inside surface of the generator set housing adjacent to a ventilation opening in the engine compartment.

2. The engine generator set as recited in claim 1, wherein the one or more cooling system components comprise a radiator coupled for providing liquid cooling to the internal combustion engine and one or more electrically driven fans coupled for providing air cooling to at least the internal combustion engine and the alternator.

3. The engine generator set as recited in claim 2, wherein the radiator is mounted above the horizontally shafted engine and alternator.

4. The engine generator set as recited in claim 2, wherein the one or more electrically driven fans are mounted below the horizontally shafted engine and alternator within an air plenum, which encompasses the electrically driven fans and draws air up and over the horizontally shafted engine and alternator.

5. The engine generator set as recited in claim 2, wherein the one or more electrically driven fans are mounted above the radiator for drawing air up and over the horizontally shafted engine and alternator.

6. The engine generator set as recited in claim 2, wherein the cooling compartment is mounted above and separated from the engine compartment by a vented partition.

7. The engine generator set as recited in claim 6, wherein the generator set housing encompasses the engine compartment, the cooling compartment, and the vented partition.

8. The engine generator set as recited in claim 7, wherein the vented partition comprises:

a pair of inclined planar sides extending completely across a width and a length of the generator set housing, wherein the inclined planar sides extend at an angle from opposing sides of the generator set housing to meet at a central ridge, wherein the angle is an acute angle measured between horizontal and each inclined planar side, and wherein openings within the central ridge enable heated air from the engine compartment to be drawn into the cooling compartment by the one or more electrically driven fans; and a ridge vent, which covers and runs a length of the central ridge to protect the engine compartment from ingress of water or debris.

9. The engine generator set as recited in claim 1, further comprising one or more on-board transformers, which are coupled to an output of the alternator and arranged within the generator set housing.

10. The engine generator set as recited in claim 1, wherein the engine compartment further comprises one or more ventilation openings arranged on one or more sides of the generator set housing to provide an air inlet into the engine compartment, and wherein the one or more air plenums are attached to one or more inside surfaces of the generator set housing adjacent to the one or more ventilation openings.

11. The engine generator set as recited in claim 10, wherein the generator set housing includes one or more access doors for providing access into the engine compartment, wherein the one or more ventilation openings are arranged on the one or more access doors, and wherein the one or more air plenums are attached to inside surfaces of the one or more access doors and centered around the one or more ventilation openings.

12. The engine generator set as recited in claim 10, wherein each air plenum is configured to closely surround one air filter to ensure that cooler, outside air is drawn into the engine via the air filter and air intake pipes, and limit the amount of heated air pulled into the air filter from the engine compartment.

13. An engine generator set, comprising:

engine compartment comprising a horizontally shafted engine and alternator;

a cooling compartment mounted above the engine compartment, wherein the cooling compartment comprises one or more electrically driven fans configured to cool the engine compartment by drawing heated air from the engine compartment;

a generator set housing encompassing the engine compartment and the cooling compartment; and a vented partition arranged within the generator set housing for separating the cooling compartment from the engine compartment, wherein the vented partition comprises a pair of inclined planar sides extending completely across the width and the length of the generator set housing, wherein the inclined planar sides extend at an angle from opposing sides of the generator set housing to meet at a central ridge, wherein the angle is an acute angle measured between horizontal and each inclined planar side, and wherein openings within the central ridge enable the heated air from the engine compartment to be drawn into the cooling compartment by the one or more electrically driven fans.

14. The engine generator set as recited in claim 13, wherein the height of the generator set housing is equal to or larger than both the width and the length of the generator set housing.

15. The engine generator set as recited in claim 13, wherein the vented partition further comprises a ridge vent, which covers and runs the length of the central ridge to protect the engine compartment from ingress of water or debris.

16. The engine generator set as recited in claim 13, wherein the cooling compartment further comprises a radiator, which is coupled for: (a) supplying a cooling liquid to the engine through inlet lines and (b) receiving a return liquid, which has been heated by the engine, through return lines, and wherein the inlet lines and return lines pass through orifices in the vented partition.

17. The engine generator set as recited in claim 16, further comprising seals coupled for sealing the orifices through which the inlet lines and return lines pass through the vented partition.

18. The engine generator set as recited in claim 13, wherein the engine compartment comprises one or more ventilation openings arranged on one or more sides of the generator set housing to provide an air inlet into the engine compartment, and wherein the cooling compartment comprises one or more ventilation openings arranged on one or more sides of the generator set housing to provide an air outlet from the cooling compartment.

19. The engine generator set as recited in claim 18, wherein the engine compartment further comprises:

one or more air filters coupled to supply filtered air to the engine via one or more air intake pipes; and one or more air plenums coupled to one or more inside surfaces of the generator set housing adjacent to the one or more ventilation openings in the engine compartment, wherein the one or more air plenums are configured to receive and surround the one or more air filters to ensure that cooler, outside air is drawn into the engine via the one or more air filters and air intake pipes, as opposed to heated air from the engine compartment.

20. The engine generator set as recited in claim 19, wherein each air filter is arranged within a separate air plenum.

21. The engine generator set as recited in claim 19, wherein each air plenum is centered around one of the ventilation openings in the engine compartment, and wherein each air plenum is configured to closely surround one air filter to limit the amount of heated air that is pulled into the air filter from the engine compartment.

22. The engine generator set as recited in claim 19, wherein the one or more air plenums are each implemented as a three-sided box having an angled bottom and open top, wherein the open top is configured to receive one of the one or more air filters, and wherein an open fourth side of the three-sided box is attached to an inside surface of the generator set housing adjacent to one of the ventilation openings in the engine compartment.

* * * * *